US005684499A

United States Patent [19]

Shimizu et al.

[11] Patent Number: 5,684,499

[45] Date of Patent: Nov. 4, 1997

[54] METHOD OF DRIVING PLASMA DISPLAY PANEL HAVING IMPROVED OPERATIONAL MARGIN

[75] Inventors: Masahiro Shimizu; Tadashi Nakamura; Yoshio Sano; Mitsuo Ueoka, all of Tokyo, Japan

[73] Assignee: NEC Corporation, Tokyo, Japan

[21] Appl. No.: 350,152

[22] Filed: Nov. 29, 1994

[30] Foreign Application Priority Data

| | | | |
|---|---|---|---|
| Nov. 29, 1993 | [JP] | Japan | 5-297139 |
| Dec. 27, 1993 | [JP] | Japan | 5-330437 |
| Dec. 28, 1993 | [JP] | Japan | 5-334486 |
| Jul. 28, 1994 | [JP] | Japan | 6-176385 |

[51] Int. Cl.[6] ..... G09G 3/28

[52] U.S. Cl. ..... 345/60; 345/68

[58] Field of Search ..... 345/60, 61, 67, 345/68, 89, 41; 315/169.4

[56] References Cited

U.S. PATENT DOCUMENTS

| | | | |
|---|---|---|---|
| 3,866,090 | 2/1975 | Van Gelder et al. | 345/67 |
| 3,881,129 | 4/1975 | Nakayama et al. | 345/67 |
| 4,130,778 | 12/1978 | Branston | 345/67 X |
| 4,613,794 | 9/1986 | Oida | 345/67 X |
| 5,317,334 | 5/1994 | Sano | 345/41 |
| 5,410,219 | 4/1995 | Takei et al. | 345/60 X |
| 5,602,559 | 2/1997 | Kimura | 345/89 |

*Primary Examiner*—Richard Hjerpe
*Assistant Examiner*—Amare Mengistu
*Attorney, Agent, or Firm*—Foley & Lardner

[57] ABSTRACT

The PDP is divided into a plurality of scan blocks. Immediately before a write discharge period of each scan block, a pre-discharge erasing period or a pre-discharge period and a pre-discharge erasing period is or are established. To minimize the period of time from the pre-discharge to the write discharge, the pre-discharge and the pre-discharge erasing are conducted for each of the scanning and sustaining electrode blocks or in a sequential manner. Furthermore, a first sustaining discharge period of a short time is disposed immediately after the write discharge period for each scan block and a second sustaining discharge period for all display cells is arranged after the write discharge of all scan blocks.

1 Claim, 30 Drawing Sheets

METHOD OF DRIVING PLASMA DISPLAY PANEL HAVING IMPROVED OPERATIONAL MARGIN

BACKGROUND OF THE INVENTION

The present invention relates to a method of driving a plasma display panel (PDP to be abbreviated as PDP herebelow), and in particular, to a method of driving a PDP of an alternating-current (ac) discharge memory type.

DESCRIPTION OF THE RELATED ART

In general, a PDP has various advantageous features, for example, constitution with a reduced thickness and a high display contrast ratio, possibility of a relatively large screen, a high response speed, capability of multi-color emission by use of fluorescent substances. These days, consequently, PDPs have been increasingly and widely employed in many fields of, for example, displays and color displays related to computer systems.

PDPs are classified into two types according to operations thereof, namely, PDPs of an ac discharge type in which electrodes are covered with dielectrics such that operation is indirectly conducted in an ac discharge state and PDPs of a direct-current (dc) type in which electrodes are exposed to a discharge space such that operation is achieved in a dc discharge state. Moreover, the PDPs of the ac discharge type are grouped into PDPs of a memory operation type including a discharge cell memory to drive operation thereof and PDPs of a refresh operation type in which operation is accomplished without using such a discharge cell memory. In this connection, a PDP has luminance in proportion to the number of discharges during each unitary period of time, namely, the number of voltage pulses applied thereto per unitary time. In PDPs of the refresh operation type, luminance is lowered as the display capacity is increased. Consequently, this type is primarily used for PDPs having a small display capacity.

FIG. 1 shows in a cross-sectional diagram the structure of a display cell 8b of a PDP conducting the ac discharge operation. As can be seen from this diagram, the display cell 8b includes two insulator substrates 19 and 13 which are made of glass and which respectively provide a front surface and a rear surface thereof, a scanning electrode 11 and a sustaining electrode 14 which are fabricated on the insulator substrate 13, a data electrode 18 formed on the insulator substrate 19 to be orthogonal to the scanning electrode 11 and the sustaining electrode 14, a discharge gas space 12 disposed between the insulator substrates 13 and 19 and filled with a discharge gas including helium, neon, xenon, or a mixture thereof, an insulation wall 12 to reserve the discharge gas space of each display cell 8b, a phosphor layer 16 made to convert an ultraviolet ray emitted due to discharge of the discharge gas into a visible light, a layer of dielectrics 10 to cover the scanning electrode 11 and the sustaining electrode 14, a protective layer 15 which is made of, for example, magnesium oxide and which protects the dielectrics 10 from being damaged by the discharge, and a layer of dielectrics 17 to cover the data electrode 18.

Referring next to FIG. 1, description will be given of a discharge operation of the selected display cell 8b. In response to a pulse voltage exceeding a discharge threshold, namely, a data pulse applied between the scanning electrode 11 and the data electrode 18, there is caused discharge therebetween. According to the polarity of the data pulse, particles having positive or negative electric charge are attracted onto surfaces of the dielectrics 10 and 17 so as to form accumulation of charge. Due to the charge accumulation, there appears an inner voltage or a wall voltage having a polarity opposite to that of the data pulse. In consequence, as the discharge continues, the effective voltage in the cell is reduced. Even if the data pulse voltage is kept at a fixed value, the discharge cannot be kept continued and is finally stopped. Thereafter, when a pulse voltage of a polarity equal to that of the wall voltage is applied between the scanning electrode 11 and the sustaining electrode 14, a voltage associated with the wall voltage is superimposed onto the effective voltage. Consequently, even when the sustaining pulse has a small voltage amplitude, the discharge threshold is resultantly exceeded and hence there occurs discharge. In consequence, continuously applying the sustaining pulse between the scanning electrode 11 and the sustaining electrode 14, the discharge can be kept continued, thereby achieving a memory function. In addition, when an erasing pulse which is a pulse having a low voltage and which has a height and a width enough to cancel the wall voltage is applied to the scanning electrode 11 or the sustaining electrode 14, the discharge can be terminated.

Incidentally, in a PDP using the ac discharge memory, to develop a stable write discharge (between the scanning and data electrode), it is effective to carry out a pre-discharge prior to the write discharge. Effect of pre-discharge is attained by optimization of wall charge of each electrode and residual of active particles (charged particles and excited particles) supplied into the discharge space. The wall charge has a relatively long life, whereas the active particles are rapidly attenuated.

FIG. 2 shows layouts of electrodes of a conventional PDP using the ac discharge memory operation.

FIG. 2 shows the electrode arrangement of a conventional PDP achieving the ac discharge memory operation in which display cells 8b are disposed in the form of a matrix having j rows and k columns in association with the electrode layout of the PDP panel 7b for the dot matrix display. As shown in FIG. 2, the PDP 7b includes scanning electrodes $S_{c1}$, $S_{c2}$, . . . , and $S_{cj}$ and sustaining electrodes $S_{u1}$, $S_{u2}$, . . . , and $S_{uj}$ which are disposed parallel to the scanning electrodes $S_{c1}$, $S_{c2}$, . . . , and $S_{cj}$ and data electrodes $D_1$, $D_2$, . . . , and $D_k$ which are vertical to the scanning and sustaining electrodes. In this configuration, when the phosphor layer 16 of FIG. 1 is provided with three colors red (R), green (G), and blue (B), there can be obtained a PDP capable of displaying color images.

FIG. 3 is a signal timing chart showing examples of waveforms of driving voltages in the PDP 7b, namely, a waveform of a common sustaining electrode driving voltage COM applied to the sustaining electrodes $S_{u1}$, $S_{u2}$, . . . , and $S_{uj}$, waveforms of scanning electrode driving pulses $S_1$, $S_2$, $S_3$, and $S_j$ respectively applied to the scanning electrodes $S_{c1}$, $S_{c2}$, . . . , and $S_{cj}$, and a waveform of a data electrode driving voltage DATA applied to a data electrode $D_i$ ($1 \leq i \leq k$).

FIG. 4 is a schematic diagram showing a cycle of driving operation in the conventional example. The driving cycle includes a pre-discharge period A(1-6), a pre-discharge erasing period B(2-6), a write discharge period C(3-6), and a sustaining discharge period D(4-6). The pre-discharge period A(1-6) and the pre-discharge erasing period B(2-6) constitute a period to generate active particles and wall charge in the discharge gas space 12, thereby attaining a stable write discharge characteristic in the write discharge period C(3-6).

Namely, in each display cell of the PDP 7b, the discharge and erasing operations are effected simultaneously according to a pre-discharge pulse 1b and a pre-discharge erasing pulse 2b. In the write discharge period C(3-6), a scanning pulse 3b is sequentially applied at an independent timing to the scanning electrodes $S_{c1}$, $S_{c2}$, . . . , and $S_{cj}$ so as to achieve a write discharge in a line sequential manner. To conduct a write operation in an $1_i$-th display cell 8b, a data pulse 6b is applied thereto at a timing of the scanning pulse 3b having the driving waveform $S_1$ to cause discharge between the scanning electrode $S_{c1}$ and the data electrode $D_i$. When a write operation is not desired for the display cell 8b, the data pulse is not applied thereto. In the sustaining discharge period D(4-6), a display cell in which a write discharge has been conducted in the scanning period is sustained in the discharge state according to the memory function. Thanks to sustaining pulses 4b and 5b, discharge is repeatedly conducted between the scanning and sustaining electrodes and hence the on state is kept retained.

In FIG. 4, a portion indicated with a slant line represents the write timing of each scanning line. After the write operation of the last scanning electrode $Sc_j$ is finished, a sustaining discharge is performed for all display cells at the same time in the sustaining discharge period D.

In the PDP driving method of the prior art, since the interval of time from a pre-discharge/a pre-discharge erasing to a write discharge varies between scanning lines, states respectively of active particles and wall charge produced by the pre-discharge/pre-discharge erasing and the characteristic state of the write operation are varied depending on the scanning lines. This leads to a drawback of a substantial decrease in the write margin.

According to the prior art, in a PDP having about 200 to about 300 scanning lines and a PDP of a low-gradation display, the scanning pulse can take a sufficiently long pulse width not less than about several microseconds (μs) so as to achieve a stable display operation. Recently, however, there has been increasingly desired in the market a PDP for use with a full-color flat display which has a large display capacity with about 500 to about 1000 scanning lines. To drive such a PDP, a high-speed write operation is required to be conducted with a data pulse width of about one to three microseconds. However, in the conventional driving method, the active particles and wall charge as seeds of discharge are insufficient in quantity. This requires the write voltage to be increased. Moreover, the write operation cannot be accomplished in a stable state and hence a satisfactory image display cannot be obtained.

In the PDP driving method described above, the period of time between the pre-discharge and the write discharge is increased with the lapse of time in the scanning pulse applying operation. Consequently, the active particles and wall charge produced by the pre-discharge are descreased in quantity and hence the write discharge is not easily achieved. This requires the scanning pulse voltage and the data pulse voltage to be increased. Furthermore, at the earlier point of time in the scanning pulse applying operation, there is elapsed a longer period of time from the write discharge to the beginning of the sustaining discharge. Consequently, the wall charge created by the write discharge is decreased and hence it is difficult to cause transition to the sustaining discharge. Moreover, in the write discharge operation, the quantity of generated wall charge is smaller than that of wall charge produced in the sustaining discharge operation in the ordinary state. In consequence, the sustaining pulse voltage is required to be increased to have a higher possibility of transition to the sustaining discharge, which leads to a substantial decrease in the memory margin.

SUMMARY OF THE INVENTION

It is therefore an object of the present invention to provide a PDP driving method capable of conducting a stable write operation and of reducing the characteristic differences between scanning lines with respect to the write discharge and the sustaining discharge, thereby removing the problems above.

In order to achieve the above object, there is provided a PDP driving method in accordance with the present invention for use with a PDP of an ac discharge memory type comprising M scanning electrodes (M being an integer) corresponding to scanning lines of display cells formed on an identical plane, M sustaining electrodes sustaining discharge of the display cells, a plurality of data electrodes disposed to be orthogonal to the scanning electrodes and the sustaining electrodes for receiving predetermined display data and being driven in response thereto to display the data, and noble gas filled in a space between the scanning and sustaining electrodes and the data electrodes. The M scanning electrodes and the M sustaining electrodes are respectively and equally subdivided into N scanning electrode groups and N sustaining electrode groups (N being a positive integer $N \geqq 2$). Each of the N scanning electrode groups and each of the N sustaining electrode groups is respectively assigned with a pre-discharge period of an identical time zone, a pre-discharge erasing period of an identical time zone, and a write discharge period of a time-shared time zone. A fixed period of time after termination of a write discharge period corresponding to an N-th (final) scanning electrode group and an N-th (final) sustaining electrode group is set as a sustaining discharge period common to all of the scanning electrode groups and all of the sustaining electrode groups.

In this connection, a pre-discharge period and a pre-discharge erasing period of each of an n-th scanning electrode group and an n-th sustaining electrode group (n being a positive integer and $1 \leqq n \leqq N$) may be duplicatedly used as a write discharge period of an (n−1)-th scanning electrode groups and an (n−1)-th sustaining electrode group.

Moreover, in accordance with the present invention, there is provided a PDP driving method for use with a PDP of an ac discharge memory type comprising M scanning electrodes corresponding to scanning lines of display cells formed on an identical plane, M sustaining electrodes (M being an integer) sustaining discharge of the display cells, a plurality of data electrodes disposed to be orthogonal to the scanning electrodes and the sustaining electrodes for receiving predetermined display data and being driven in response thereto to display the data and noble gas filled in a space between the scanning and sustaining electrodes and the data electrodes. The M scanning electrodes and the M sustaining electrodes are respectively and equally subdivided into N scanning electrode groups and N sustaining electrode groups (N being a positive integer $N \geqq 2$). A pre-discharge period of an identical time zone is set to all of the scanning electrode groups or all of the sustaining electrode groups and thereafter a pre-discharge erasing period of an identical time zone and a write discharge period of a time-shared time zone are respectively set to each of the N scanning electrode groups and each of the N sustaining electrode groups. A fixed period of time after termination of a write discharge period corresponding to an N-th (final) scanning electrode group and an N-th (final) sustaining electrode group is set as a sustaining discharge period common to all of the scanning electrode groups and all of the sustaining electrode groups.

Incidentally, and a pre-discharge erasing period of each of an n-th scanning electrode group and an n-th sustaining electrode group may be duplicatedly used as a write discharge period of an (n−1)-th scanning electrode groups and an (n−1)-th sustaining electrode group.

In accordance with the present invention, there is additionally provided a PDP driving method for use with a PDP of an ac discharge memory type including M scanning electrodes (M being an integer) corresponding to scanning lines of display cells formed on an identical plane, M sustaining electrodes (M being an integer) sustaining discharge of the display cells, and a plurality of data electrodes disposed to be orthogonal to the scanning electrodes and the sustaining electrodes for receiving predetermined display data and being driven in response thereto. There are disposed a pre-discharge period, a pre-discharge erasing period, and a write period. At least the pre-discharge erasing period and the write period are combined into a set, thereby sequentially conducting a scanning operation according to the set.

In accordance with the present invention, there is provided a PDP driving method for use with a PDP of an ac discharge memory type comprising M scanning electrodes (M being an integer), a plurality of data electrodes for data display, being disposed to be orthogonal to the scanning electrodes, and being driven in response to supply of display data thereto, noble gas filled in a space between the scanning electrodes and the data electrodes. The method includes a write discharge period for a time-shared display selection for each of the scanning electrodes, a sustaining discharge period for conducting a sustaining discharge according to the display selection in the write discharge period, a pre-discharge period disposed at a point of time prior to a write discharge operation, simultaneously applying consecutive pre-discharge pulses and pre-discharge erasing pulses to all of the scanning electrodes, subdividing the number M by N for creating N scanning electrode groups, disposing a first sustaining discharge period after termination of the write discharge period of each of the N scanning electrode groups, and disposing a second sustaining discharge period common to all of the scanning electrodes after termination of the first sustaining discharge period of a final one of the scanning electrode groups.

The PDP driving method includes the steps of simultaneously applying a pre-discharge pulse to all of the scanning electrodes, subdividing the number M by N for creating N scanning electrode groups, disposing a pre-discharge erasing period and a write discharge period simultaneously therewith for each of the N scanning electrode groups and a first sustaining discharge period after termination of the write discharge period, and disposing a second sustaining discharge period common to all of the scanning electrodes after termination of the first sustaining discharge period of a final one of the scanning electrode groups.

Furthermore, the PDP driving method includes the steps of subdividing number M by N for creating N scanning electrode groups, disposing in a consecutive and simultaneous manner a pre-discharge period, a pre-discharge erasing period, and a write discharge period for each of the N scanning electrode groups and a first sustaining discharge period after termination of the write discharge period, and disposing a second sustaining discharge period common to all of the scanning electrodes after termination of the first sustaining discharge period of a final one of the scanning electrodes.

In accordance with the present invention, there is provided a PDP driving method for use with a PDP of an ac discharge memory type comprising M scanning electrodes, M sustaining electrodes disposed in pair with respect to the M scanning electrodes, N sets of scanning electrode groups and N sets of sustaining electrode groups obtained by respectively subdividing the M scanning electrodes and the M sustaining electrodes, a plurality of data electrodes disposed to be orthogonal to the scanning electrodes for receiving supply of display data and being driven in response thereto to display the data, and noble gas filled in a space between the scanning and sustaining electrodes and the data electrodes, thereby forming a plurality of display cells. The method includes a pre-discharge period of a batch type for each of blocks formed with the scanning and sustaining electrodes, a write discharge period for a sequential scanning for each of the blocks, a first sustaining discharge period for each of the blocks immediately after a write discharge synchronized with a pre-discharge period of another one of the blocks, and a second sustaining discharge period simultaneous for all of the blocks. The pre-discharge period of the pertinent block is a third sustaining discharge period of at least one of the blocks other than the pertinent block.

Furthermore, there is provided a PDP driving method in accordance with the present invention for use with a PDP of an ac discharge memory type comprising M scanning electrodes, M sustaining electrodes disposed in pair with respect to the M scanning electrodes, N sets of scanning electrode groups and N sets of sustaining electrode groups obtained by respectively subdividing the M scanning electrodes and the M sustaining electrodes, a plurality of data electrodes disposed to be orthogonal to the scanning electrodes for receiving supply of display data and being driven in response thereto to display the data, and noble gas filled in a space between the scanning and sustaining electrodes and the data electrodes, thereby forming a plurality of display cells. The method includes subdividing into a plurality of sub-fields a repetitious display cycle in which a display operation is repeatedly conducted for all of the display cells according to predetermined display data, using a different number of sustaining discharges for each of the sub-fields, generating luminance gradation according to a combination of sub-fields undergone display selection for each of the display cells, a pre-discharge period of a batch type for each of blocks formed with the scanning and sustaining electrodes, a write discharge period for a sequential scanning for each of the blocks, a first sustaining discharge period for each of the blocks immediately after a write discharge synchronized with a pre-discharge period of another one of the blocks, and a second sustaining discharge period simultaneous for all of the blocks. The pre-discharge period of the pertinent block is a third sustaining discharge period of at least one of the blocks other than the pertinent block.

In accordance with the present invention, there is provided a PDP driving method for use with a PDP of an ac discharge memory type comprising M scanning electrodes, M sustaining electrodes disposed in pair with respect to the M scanning electrodes, N sets of scanning electrode groups and N sets of sustaining electrode groups obtained by respectively subdividing the M scanning electrodes and the M sustaining electrodes, a plurality of data electrodes disposed to be orthogonal to the scanning electrodes for receiving supply of display data and being driven in response thereto to display the data, and noble gas filled in a space between the scanning and sustaining electrodes and the data electrodes, thereby forming a plurality of display cells. The method includes a pre-discharge period of a batch type for each of blocks formed with the scanning and sustaining electrodes, a write discharge period for a sequential scanning for each of the blocks, a first sustaining discharge period for each of the blocks immediately after a write discharge synchronized with a pre-discharge period of another one of the blocks, and a second sustaining discharge period simultaneous for all of the blocks. Alternatively, the method includes in addition thereto a third sustaining discharge period synchronized with a pre-discharge period of another block. Sustaining pulses constituting the first or third sustaining discharge period in phase with pre-discharge pulses or with pre-discharge and pre-discharge erasing pulses applied to a scanning or sustaining electrodes of the block under the pre-discharge are applied at least in a block on a side of or on each side of the block under the pre-discharge.

Furthermore, there is provided a PDP driving method in accordance with the present invention for use with a PDP of an ac discharge memory type comprising M scanning electrodes, M sustaining electrodes disposed in pair with respect to the M scanning electrodes, N sets of scanning electrode groups and N sets of sustaining electrode groups obtained by respectively subdividing the M scanning electrodes and the M sustaining electrodes, a plurality of data electrodes disposed to be orthogonal to the scanning electrodes for receiving supply of display data and being driven in response thereto to display the data, and noble gas filled in a space between the scanning and sustaining electrodes and the data electrodes, thereby forming a plurality of display cells. The method includes a pre-discharge period of a batch type for each of blocks formed with the scanning and sustaining electrodes, a write discharge period for a sequential scanning for each of the blocks, and a second sustaining discharge period simultaneous for all of the blocks. A cancel pulse in phase with a pre-discharge pulse or with a pre-discharge pulse and a pre-discharge erasing pulse applied to the scanning or sustaining electrodes of the block under the pre-discharge is applied at least to the scanning electrode group, the sustaining electrode group, or the scanning electrode and sustaining electrode groups of one of or either of the sides of the block under the pre-discharge.

In this connection, the cancel pulse is a pulse applied to the overall pre-discharge period of the block under the pre-discharge.

As described in conjunction with the prior art example, to achieve a stable write discharge in a PDP of the ac discharge memory type, it is efficient to conduct a pre-discharge prior to the write discharge. Effect of the pre-discharge is developed according to optimization of the wall charge on each electrode and residuals of active particles (such as charged particles and excited particles) produced in the discharge space. The wall charge has a relatively long life, whereas the active particles are rapidly attenuated. According to the present invention, the problem of the conventional technology has been solved by the means described above. That is, in accordance with the present invention, the period of time from the pre-discharge erasing to the write discharge is reduced by disposing electrodes formed in several blocks and scanning operations including the pre-discharge/pre-discharge erasing. Unlike the conventional method, the method of the present invention positively and effectively utilizes as seeds of discharge the active particles produced by the pre-discharge, thereby conducting a high-speed write operation. In this method, the discharge is effected in a state where the cells are filled with the active particles produced by the pre-discharge and/or pre-charge erasing. Since there exists a sufficient quantity of discharge seeds, increase in the write discharge voltage can be suppressed and hence a stable write operation can be executed at a high speed. Moreover, the strict control operation of the wall charge, which is indispensable in the driving method of the prior art, becomes unnecessary. As can be seen from FIG. 15, in a region in which the period of time from the pre-discharge erasing to the write discharge is about 500 μs, about 200 μs, or about 100 μs, even when the data pulse width is respectively about 3 μs, 2 μs, or 1 μs, the write discharge can be conducted without increasing the data pulse voltage. As above, when the period of time from the pre-discharge erasing to the write discharge is appropriately controlled in association with the data pulse width and the scanning pulse width, the write operation can be accomplished at a high speed, which is efficient when driving a PDP having a large display capacity.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
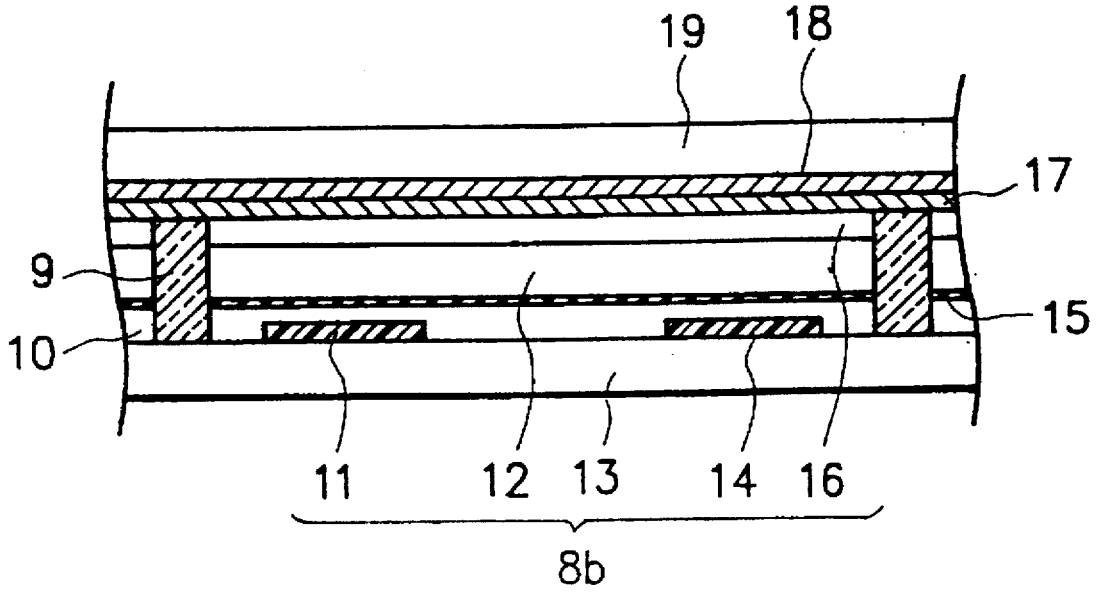
FIG. 1 PRIOR ART
FIG. 1 is a cross-sectional diagram showing constitution of a display cell of a PDP using an ac discharge memory operation.

Referring now to the drawings, description will be given of embodiments of the PDP driving method in accordance with the present invention.

Figure 5:
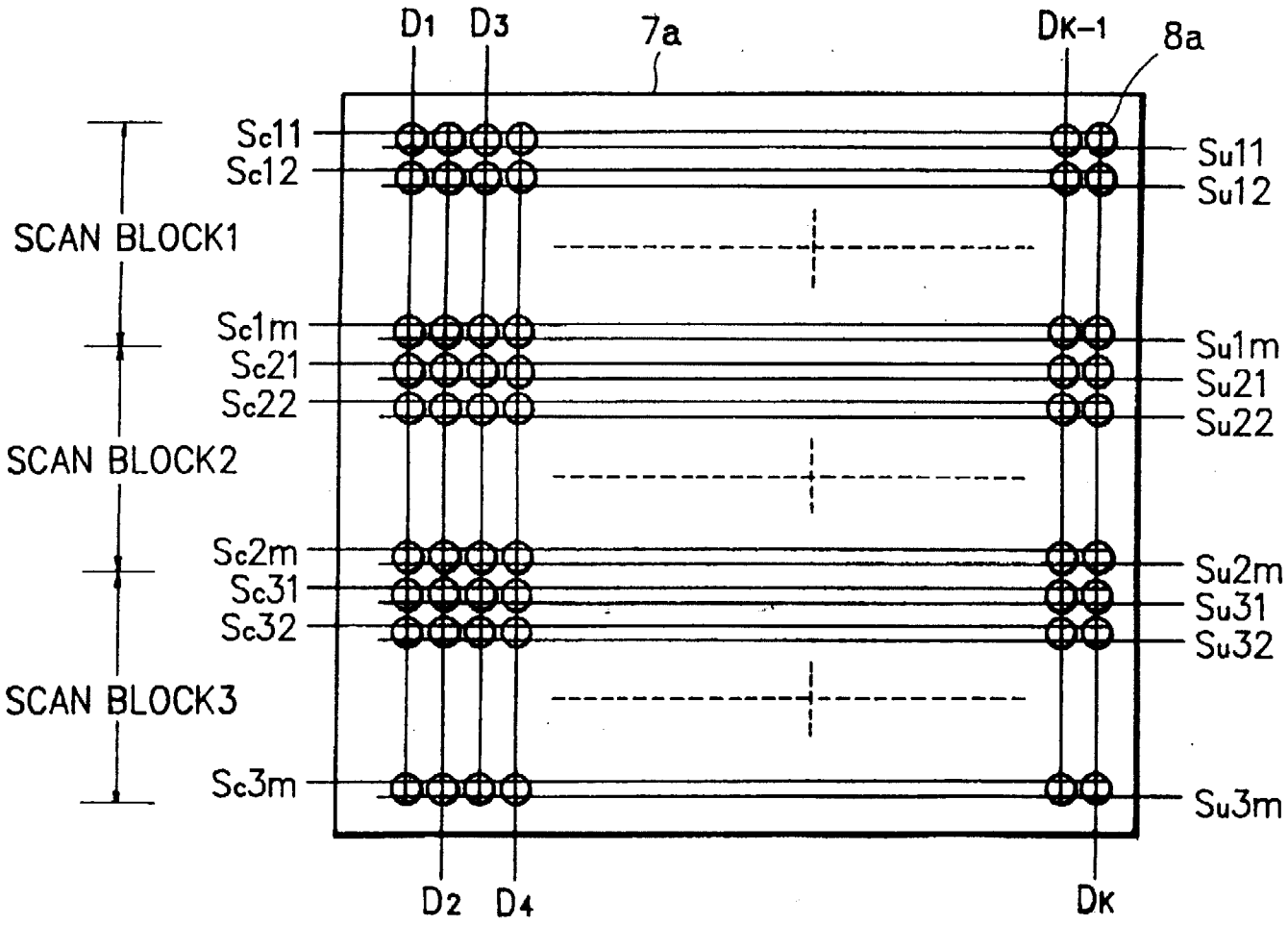
FIG. 5 is a plan view showing the electrode layout of a PDP using an ac discharge memory operation to which the present invention is applied.

FIG. 5 shows an electrode layout of a PDP of an ac discharge memory operation type to which the present invention is applied. In FIG. 5, there is shown an electrode layout of a PDP 7*a* in which display cells 8*a* are arranged in a matrix shape including 3 m rows and k columns.

Figure 6:
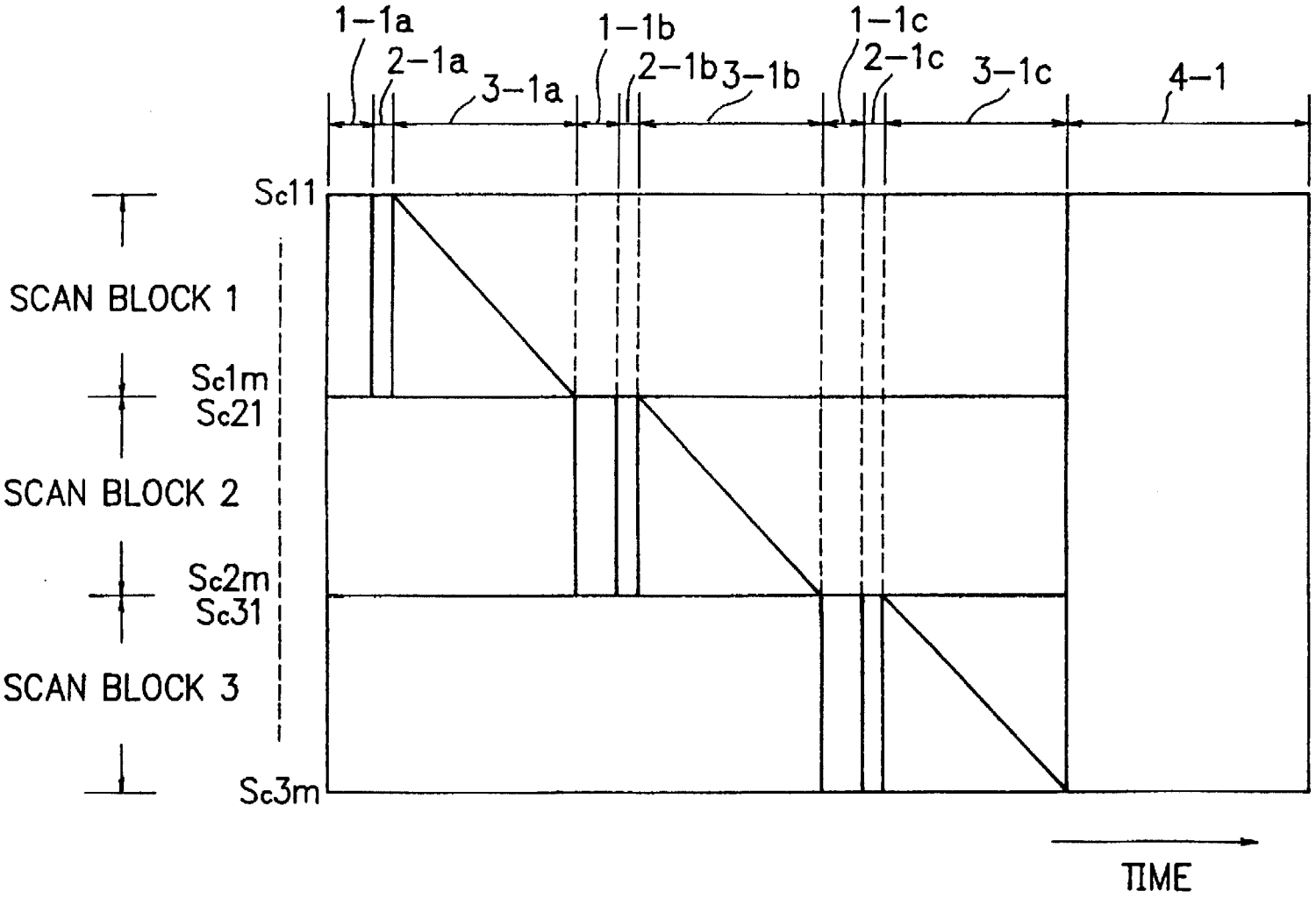
FIG. 6 is a schematic diagram chart showing partitions of a drive timing period in a first embodiment in accordance with the present invention.

FIG. 6 schematically shows an internal configuration of a cycle of the driving timing of a first embodiment in accordance with the present invention. In this example, the overall scanning lines are subdivided into three partitions including scan blocks 1 to 3. In FIG. 6, there is a pre-discharge period (1-1*a*) in which a pre-discharge is simultaneously effected for all display cells 8*a* (FIG. 5) of the first block of the divided scanning lines, namely, scan block 1. The pre-discharge period (1-1*a*) is followed by a pre-discharge erasing period (2-1*a*) in which pre-discharge erasing is simultaneously carried out for all display cells 8*a* of scan block 1. In a write discharge period (3-1*a*) succeeding the pre-discharge erasing period (2-1*a*), a write pulse is applied to scanning lines in a line sequential manner beginning at a first scanning line of the block. In the graph of FIG. 6, a portion indicated by a slant line is associated with write timing of each scanning line. After a write operation is finished in scan block 1, there is a pre-discharge period (1-1*b*) in which pre-discharge is simultaneously conducted for all display cells 8*a* (FIG. 5) of the scan block 2. Subsequently, the driving operation is repeatedly accomplished for the other scan blocks in a similar manner. When the write period is completed for the last scan block, i.e., scan block 3 in this fashion, there appears a sustaining discharge period (4-1) in which a sustaining discharge is simultaneously achieved for all scan blocks. Through the repetitious operation of the driving sequence, there is attained a desired display image.

Figure 7:
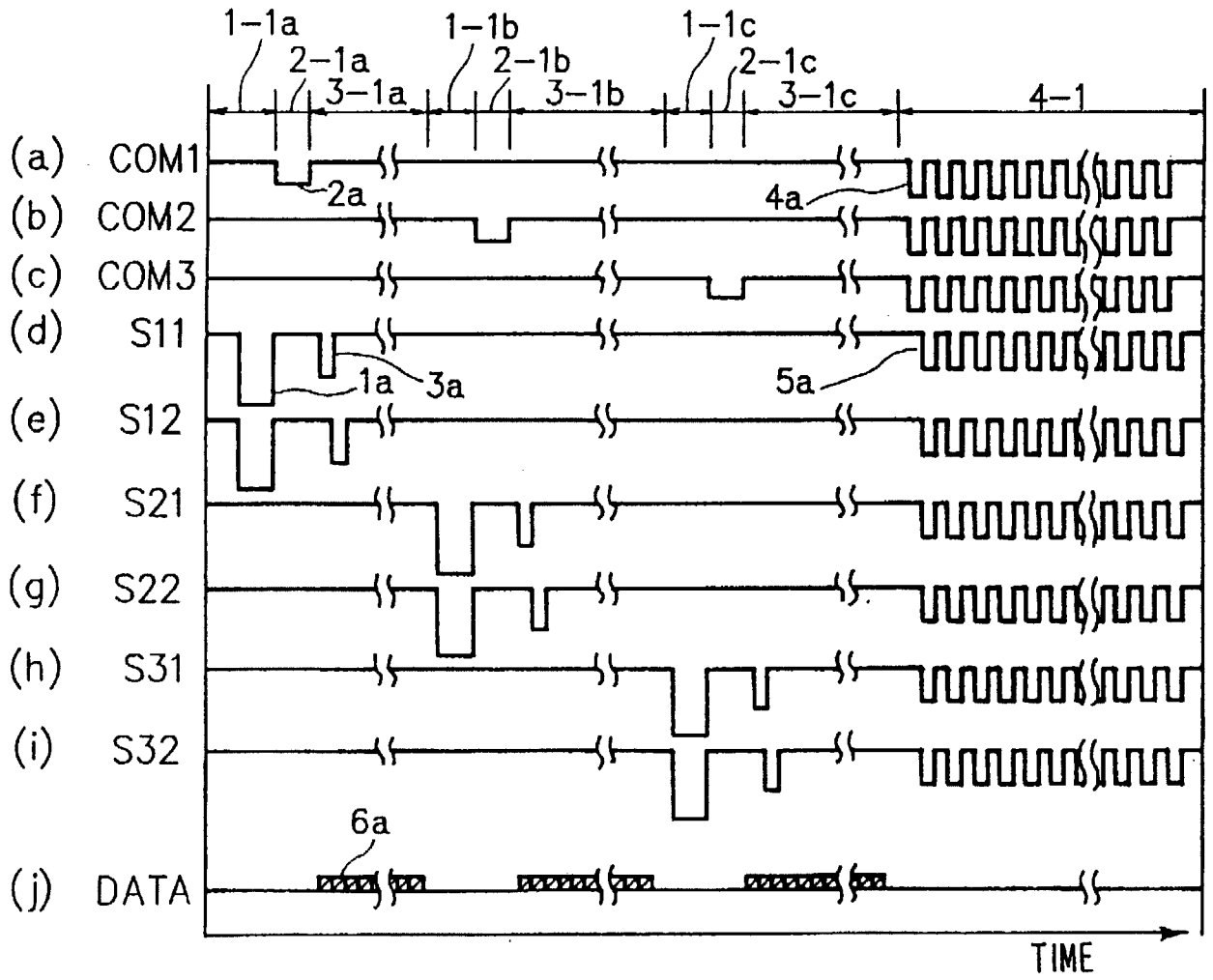
FIG. 7 is a signal timing chart showing an example of driving voltage waveforms in the first embodiment.

FIG. 7 is a signal timing chart showing an example of driving voltage waveforms in the first embodiment. In FIG. 7, portions (a) to (c) respectively show sustaining electrode waveforms $COM_1$, $COM_2$, and $COM_3$ respectively and commonly applied to the sustaining electrodes $S_{u11}$ to $S_{u1m}$ of scan block 1, $S_{u21}$ to $S_{u2m}$ of scan block 2, and $S_{u31}$ to $S_{u3m}$ of scan block 3 of PDP 7*a* shown in FIG. 5. Portions (d) to (i) respectively show scan electrode pulses $S_{11}$ and $S_{12}$, $S_{21}$ and $S_{22}$, and $S_{31}$ and $S_{32}$ respectively applied to the scan electrodes $S_{c11}$ and $S_{c12}$ of scan block 1, $S_{c21}$ and $S_{c22}$ of scan block 2, and $S_{c31}$ and $S_{c32}$ of scan block 3 shown in FIG. 5. A portion (j) shows a data electrode drive waveform DATA applied to the data electrode $D_i$ ($1 \leqq i \leqq k$) of FIG. 5. In this portion of the data electrode drive waveform DATA, a slant line indicates that the data pulse 6*a* is selected to the on or off state according to presence or absence of data, respectively.

In the pre-discharge period (1-1*a*) of scan block 1, a pre-discharge pulse 1*a* is applied to all scanning electrodes of the pertinent block. Subsequently, in the pre-discharge erasing period (2-1*a*). pre-discharge erasing pulse 2*a* is similarly applied to all sustaining electrodes of the block. In the following write discharge period (3-1*a*), a scanning pulse 3*a* is sequentially applied to the scanning electrodes $S_{c11}$, $S_{c12}, \ldots, S_{c1m}$. Hereafter, (11-*i*) shows the cross point cell of the scanning electrode $S_{c11}$, the sustaining electrode $S_{u11}$, and the data electrode Di. When writing data in a (11-*i*)-th display cell 8*a*, a data pulse 6*a* is applied thereto at a timing point of the scanning pulse 3*a* to cause discharge between the scanning electrode $S_{c11}$ and the data electrode $D_i$. When such a write operation is not to be achieved for the (11-*i*)-th display cell 8*a*, the data pulse 6*a* is not applied. When the scanning is finished for the scanning electrode $S_{c1m}$, namely, when the write discharge is completed, there are sequentially conducted the pre-discharge, pre-discharge erasing, and scanning for scan blocks 2 and 3 in this order.

When the pre-discharge, pre-discharge erasing, and scanning are accomplished for all scan blocks in the above sequence, there is provided the sustaining pulse period (4-1) in which sustaining pulses 4*a* and 5*a* are alternately applied to the sustaining electrodes $S_{u11}$, to $S_{u1m}$, $S_{u21}$ to $S_{u2m}$, and $S_{u31}$ to $S_{u3m}$ and the scanning electrodes $S_{c11}$ to $S_{c1m}$, $S_{c21}$ to $S_{c2m}$, and $S_{c31}$ to $S_{c3m}$, respectively. The period (4-1) is finished after sustaining pulses are applied in accordance with the required luminance of light illumination.

Figure 8:
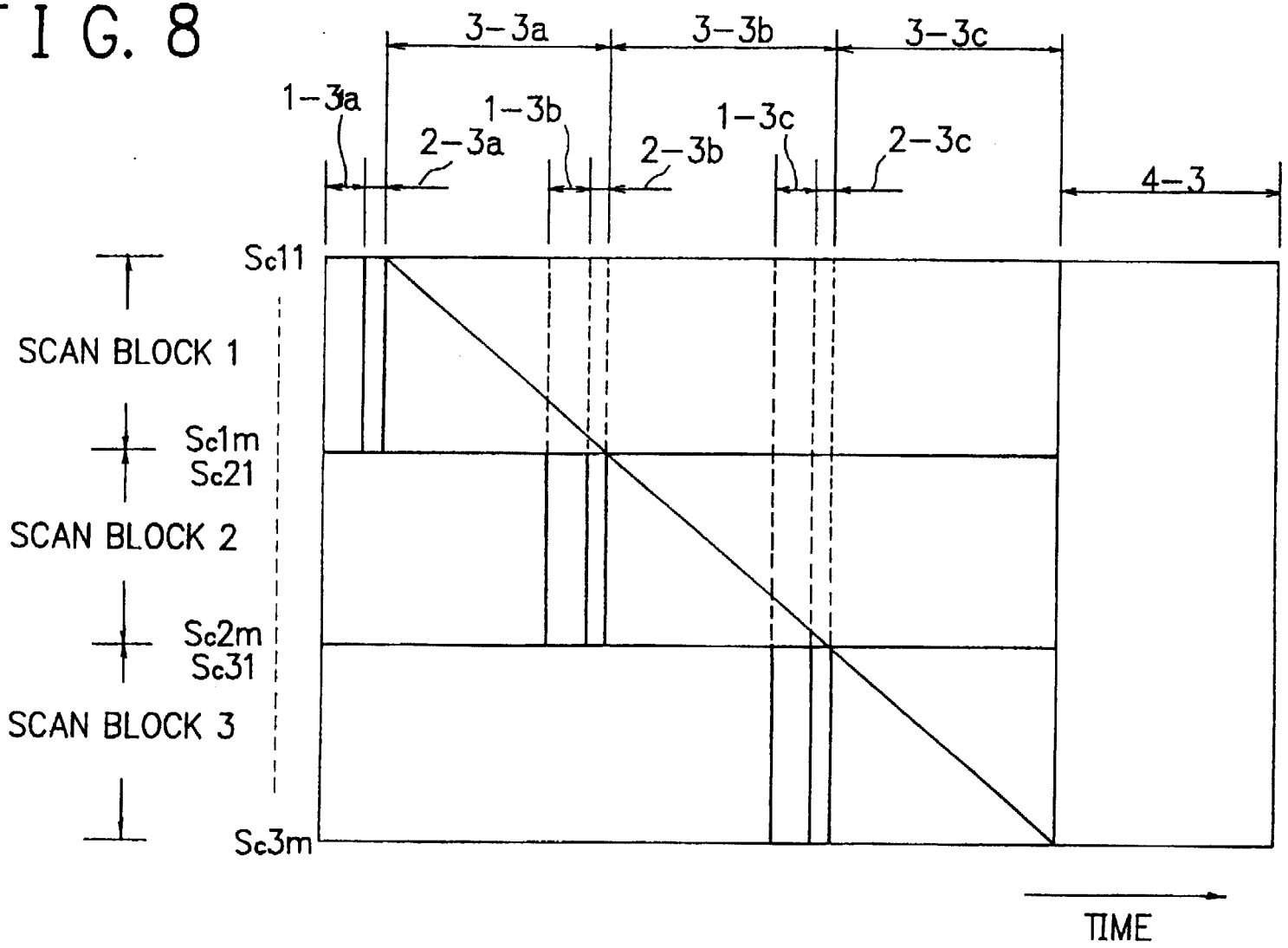
FIG. 8 is a schematic diagram chart showing partitions of a drive timing period in a second embodiment in accordance with the present invention.

FIG. 8 next illustratively shows an internal configuration of a cycle of drive timing of a second embodiment in accordance with the present invention. The overall scanning lines are partitioned into three blocks including scan blocks 1 to 3. In FIG. 8, there is provided a pre-discharge period (1-3*a*) in which pre-discharge is simultaneously effected for all display cells 8*a* (FIG. 5) of the first block of the divided scanning lines, namely, scan block 1. Following pre-discharge period (1-3*a*), there are disposed a pre-discharge erasing period (2-3*a*) in which pre-discharge erasing is simultaneously carried out for all display cells 8*a* of scan block 1 and a write discharge period (3-3*a*). During the write discharge period (3-3*a*) of scan block 1, a pre-discharge period (1-3*b*) and a pre-discharge erasing period (2-3*b*) are sequentially initiated and then the write discharge of scan block 1 and the pre-discharge erasing of scan block 2 are simultaneously terminated. In this operation, the write discharge of scan block 2 is started immediately after the write discharge of scan block 1. Subsequently, the driving operation is repeatedly accomplished up to scan block 3 in a similar fashion. When the write discharge period (3-3c) is completed for the last scan block 3 in this manner, there appears a sustaining discharge period (4-3) in which sustaining discharge is simultaneously achieved for all scan blocks including scan blocks 1 to 3. As a result of the repetitious operation of the driving sequence, there is obtained a desired display image.

Although a specific example of driving waveforms of the embodiment can be configured using a combination of the respective basic pulses of the first embodiment, description thereof will be avoided due to redundancy thereof. This is also the case with third and fourth embodiments in accordance with the present invention.

Figure 9:
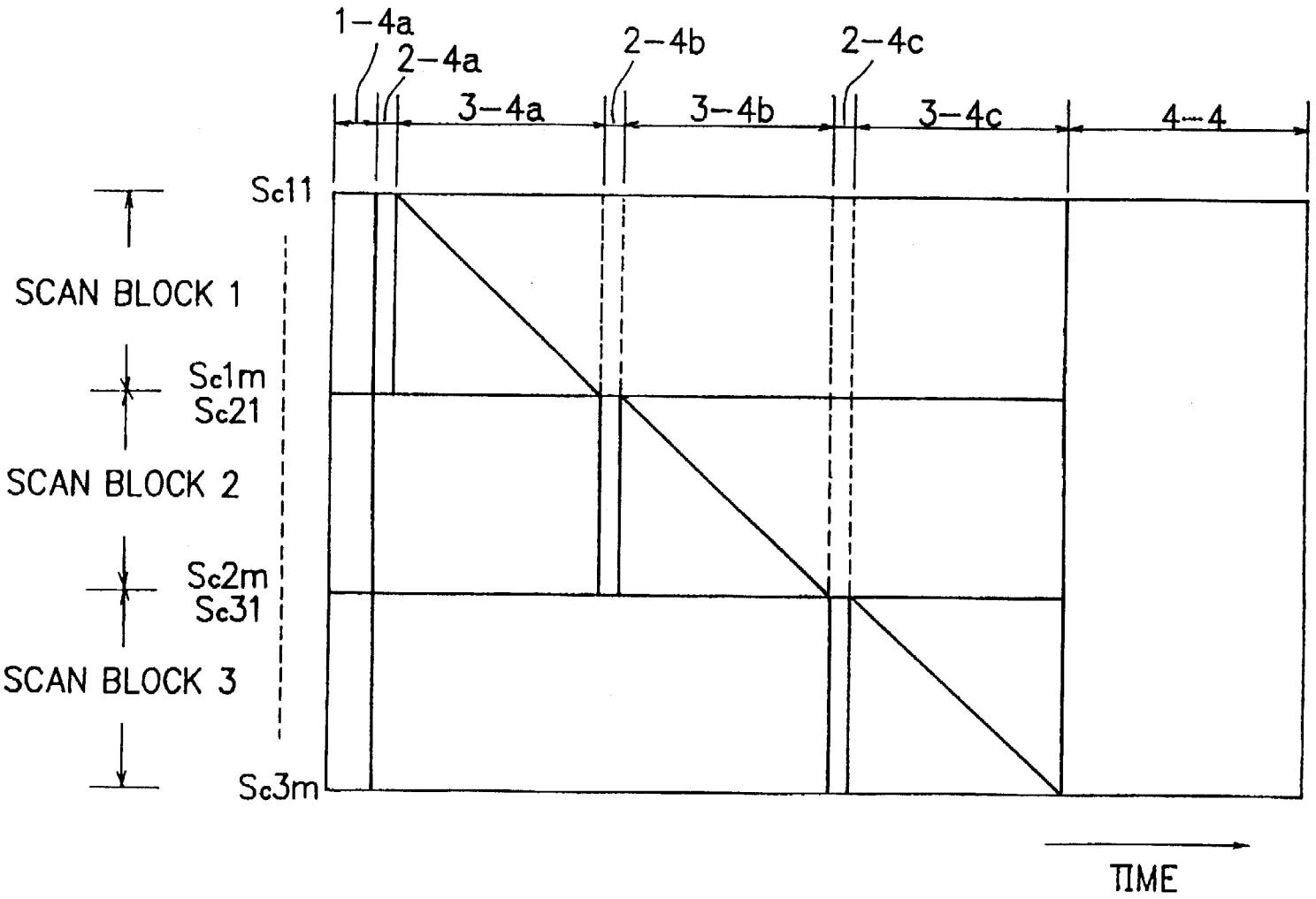
FIG. 9 is a schematic diagram chart showing partitions of a drive timing period in a third embodiment in accordance with the present invention.

FIG. 9 schematically shows an internal structure of a cycle of driving timing of a third embodiment in accordance with the present invention. In this example, the overall scanning lines are subdivided, like in the first and second embodiments, into three sections including scan blocks 1 to 3. In FIG. 9, there first appears a pre-discharge period (1-4a) in which a pre-discharge is simultaneously effected for all display cells 8a of all scan blocks. This period (1-4a) is followed by a pre-discharge erasing period (2-4a) in which pre-discharge erasing is simultaneously carried out for all display cells 8a of only scan block 1. The period (2-4a) is followed by a write discharge period (3-4a) in which pre-discharge erasing is effected for all display cells 8a of only block 1 and a write discharge period (3-4a). After a write operation is finished in scan block 1, there is a pre-discharge erasing period (2-4b) in which pre-discharge erasing is simultaneously conducted for all display cells 8a of only scan block 2 and a write discharge period (3-4b) thereof. Subsequently, the driving operation is accomplished for scan block 2 in a similar manner, when the write discharge period (3-4c) is completed for the last scan block 3, there exists a sustaining discharge period (4-4) in which a sustaining discharge is simultaneously achieved for all scan blocks including scan blocks 1 to 3. Through the repetitious operation of the driving sequence, there is obtained a desired display image.

Figure 10:
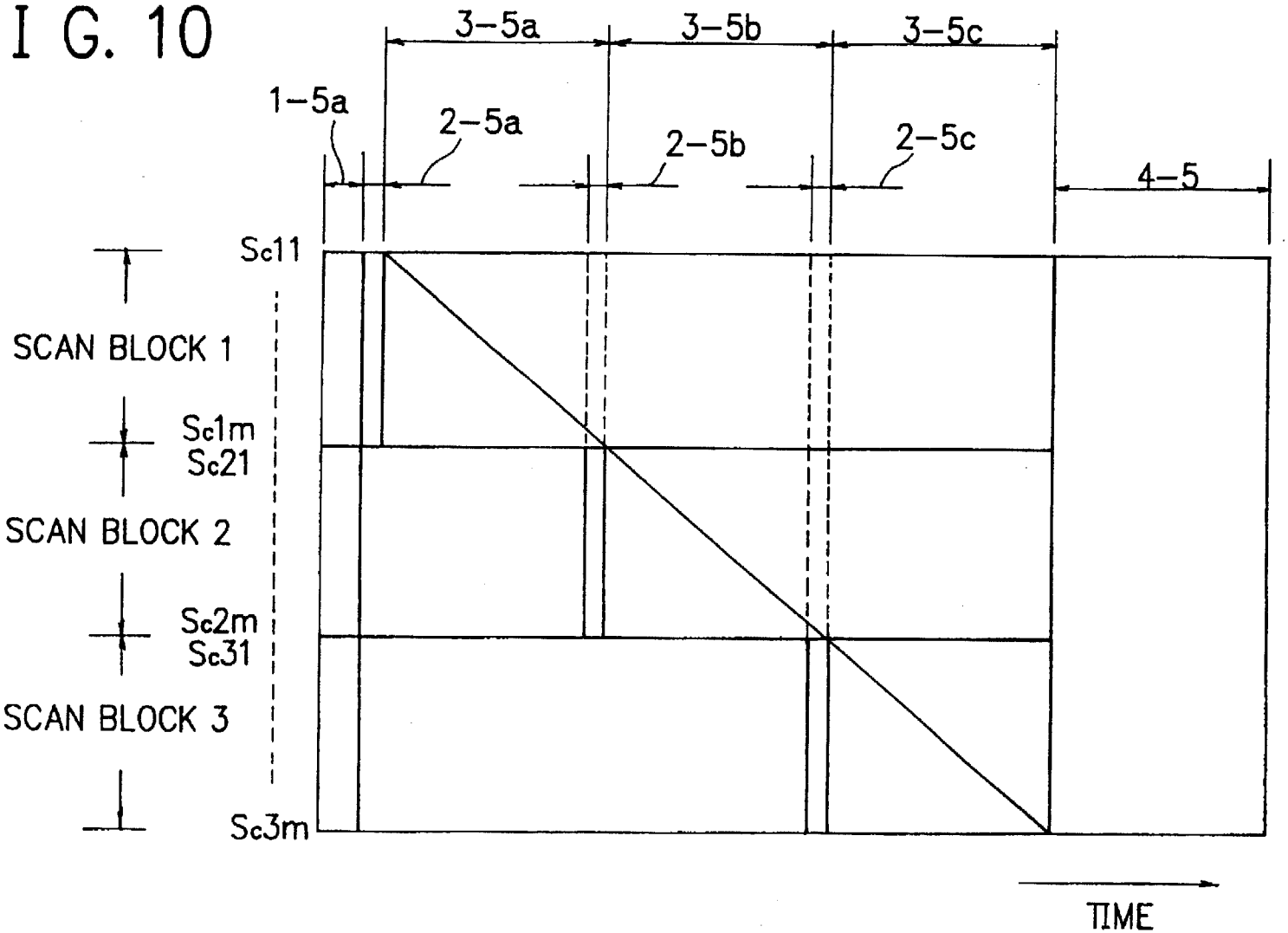
FIG. 10 is a schematic diagram chart showing partitions of a drive timing period in a fourth embodiment in accordance with the present invention.

Subsequently, FIG. 10 is a schematic diagram showing an internal construction of a cycle of driving timing of a fourth embodiment in accordance with the present invention. In this example, the overall scanning lines are also subdivided, like in the above embodiments, into three partitions including scan blocks 1 to 3. In FIG. 10, there first appears a pre-discharge period (1-5a) in which a pre-discharge is simultaneously carried out for all display cells 8a of all scan blocks. Subsequent to this period (1-5a) are a pre-discharge erasing period (2-5a) in which pre-discharge erasing is simultaneously conducted for all display cells 8a of only scan block 1 and a write discharge period (3-5a) thereof. During the write discharge period (8-5a) of scan block 1, a pre-discharge erasing period (2-5b) of scan block 2 is commenced and the write discharge of scan block 1 and the pre-discharge erasing of scan block 2 are terminated at the same time. In this operation, the write discharge of scan block 2 is started immediately after the write discharge of scan block 1. Thereafter, the driving operation is repeatedly effected in a similar manner up to scan block 3. When the write discharge period (3-5c) is completed for the last scan block 3, there exists a sustaining discharge period (4-5) in which a sustaining discharge is simultaneously achieved for all scan blocks, i.e., scan blocks 1 to 3. As a result of the repetitious operation of the driving sequence, there is developed a desired display image.

In association with the above embodiments, in the methods employed in the first and third embodiments, although there is required a period of time dedicated to the pre-discharge and the pre-discharge erasing and hence the write period and the sustaining discharge period become shorter, these methods are free of any problem related to interference between the blocks. On the other hand, in the methods used in the second and fourth embodiments, although there exists reduction of operational margin and there is required fine adjustment due to interference between the blocks, the available period of time can be efficiently used and hence luminance as well as the display capacity can be effectively increased.

Description has been briefly given of methods of driving a plasma display panel configured in several blocks. When applying these methods actually to such a PDP having a large display capacity, it is possible to reduce the period of time from the pre-discharge or the discharge of pre-discharge erasing to the write discharge in each block. This guarantees the write operation and makes it possible to minimize the pulse width of the write discharge. However, since the number of blocks is increased, the driving circuit and the control circuit thereof become complicated. Moreover, in a case like in the first embodiment in which the pre-discharge period and the pre-discharge erasing period are independent of each other, when the number of blocks is increased, there arises a problem that the period of time available for the write discharge is decreased. In consequence, the number of blocks and the scanning pulse width need only be selected according to design of an objective product or device while paying attention to the problem above. For example, in a case of a PDP having 256 gradation levels, 480 scanning lines, and eight sub-fields, there is displayed a satisfactory image when the scanning lines are subdivided into four blocks and the scanning pulse width is set to about 2.5 μs. In this situation, the period of time from the discharge of pre-discharge erasing to the last write scanning in the pertinent block is 300 μs. Furthermore, a PDP having 256 gradation levels and 1000 scanning lines can be also efficiently driven when the PDP is subdivided into ten blocks and the scanning pulse width is set to about 1.0 μs.

In this case, the period of time from the discharge of pre-discharge erasing to the last write scanning in the pertinent block is 100 μs or less.

Figure 2:
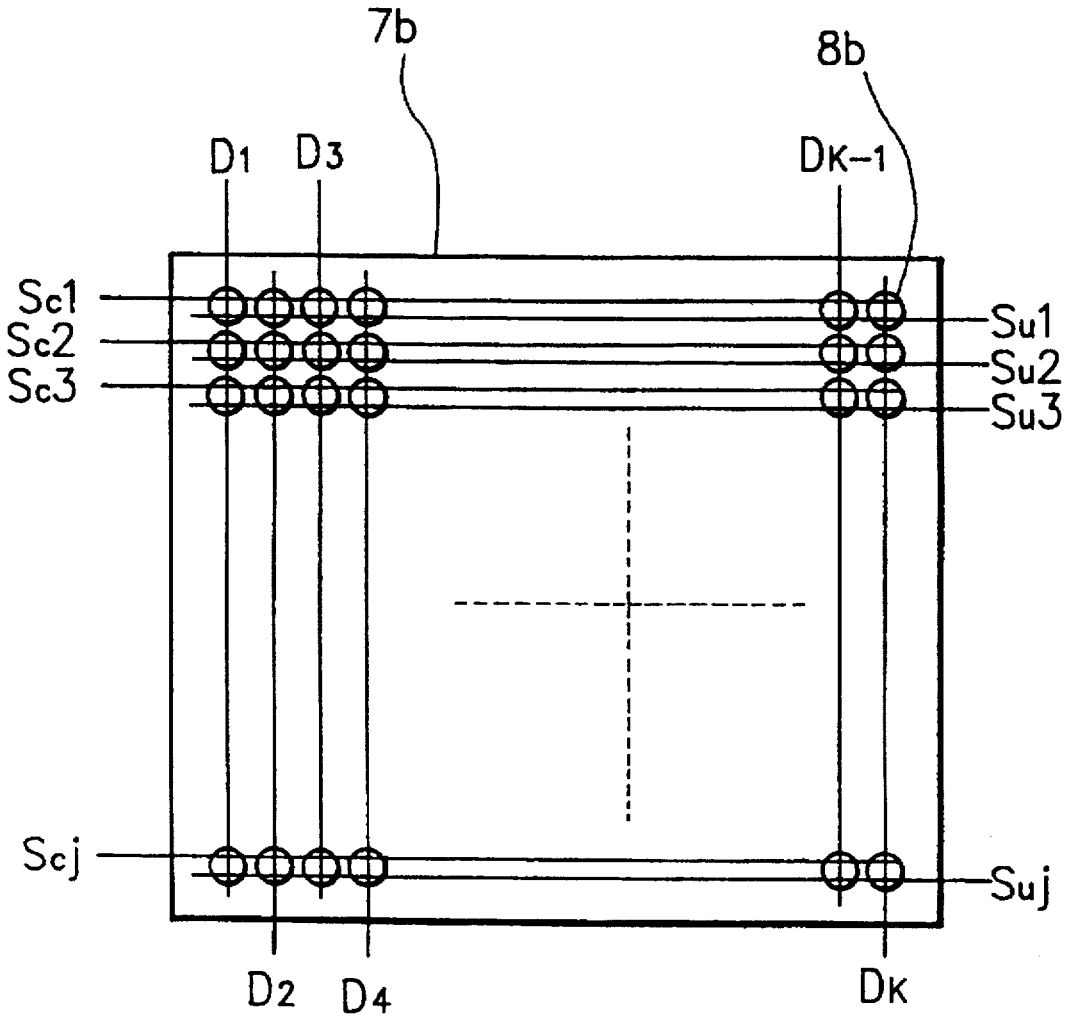
FIG. 2 PRIOR ART
FIG. 2 is a plan view showing the electrode layout of a PDP using an ac discharge memory operation as a conventional example.
Figure 3:
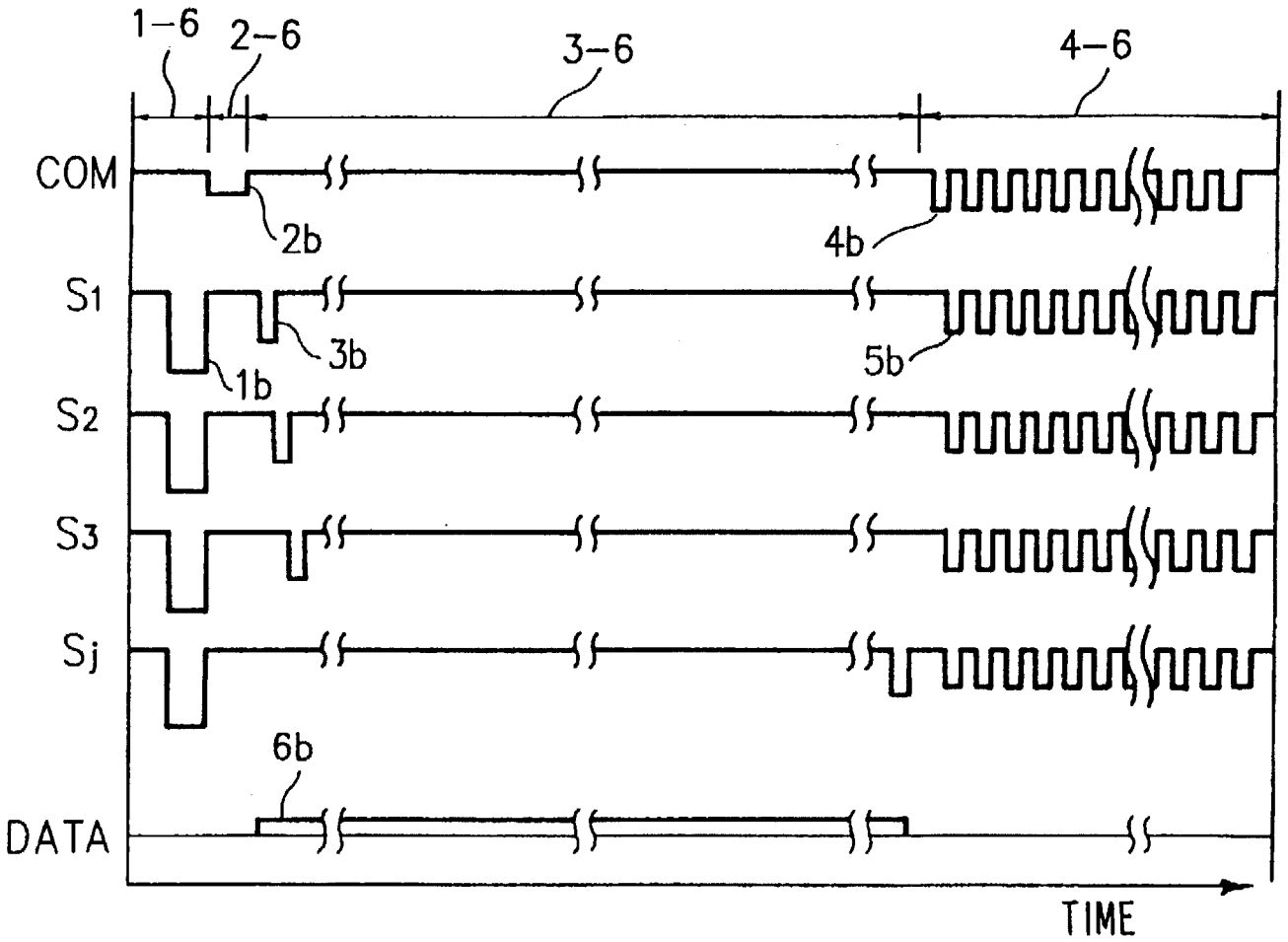
FIG. 3 PRIOR ART
FIG. 3 is a signal timing chart showing an example of driving voltage waveforms in the conventional example.
Figure 4:
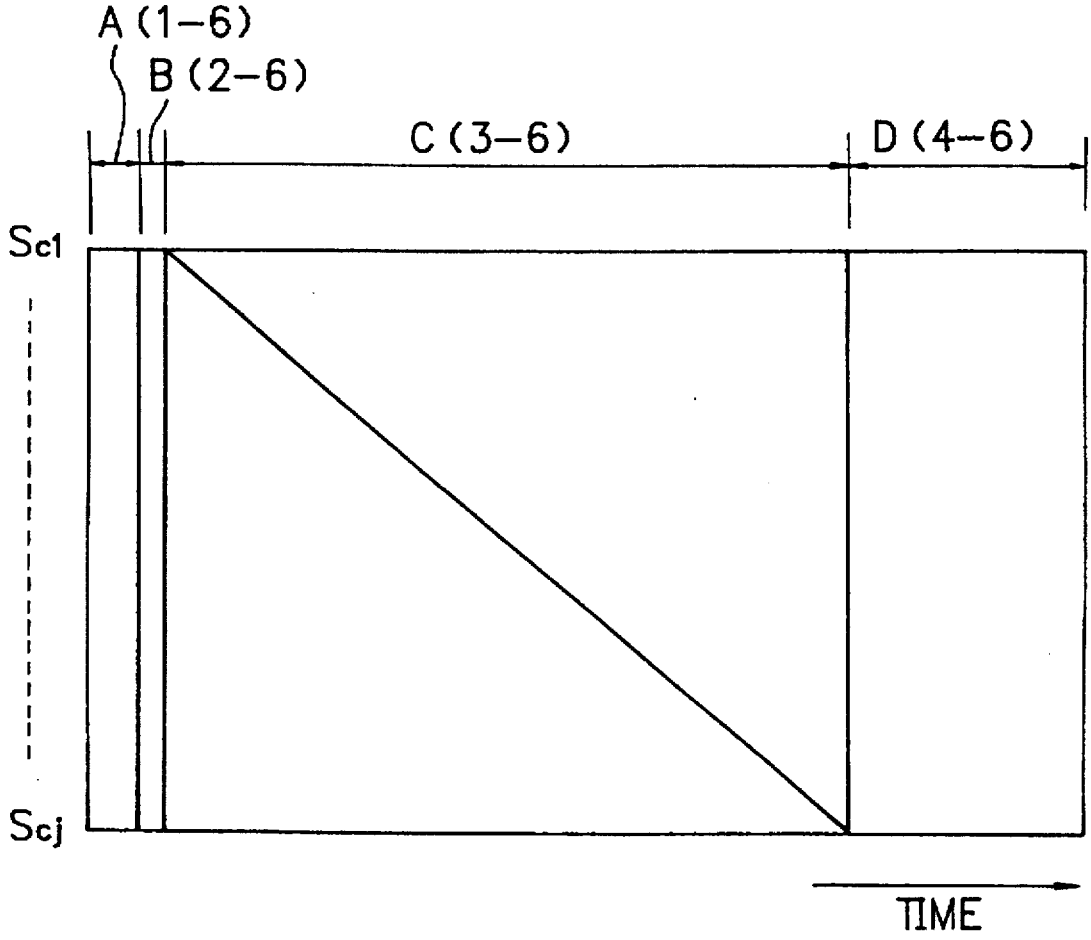
FIG. 4 PRIOR ART
FIG. 4 is a schematic diagram chart showing partitions of a drive timing period of the conventional example.
Figure 11:
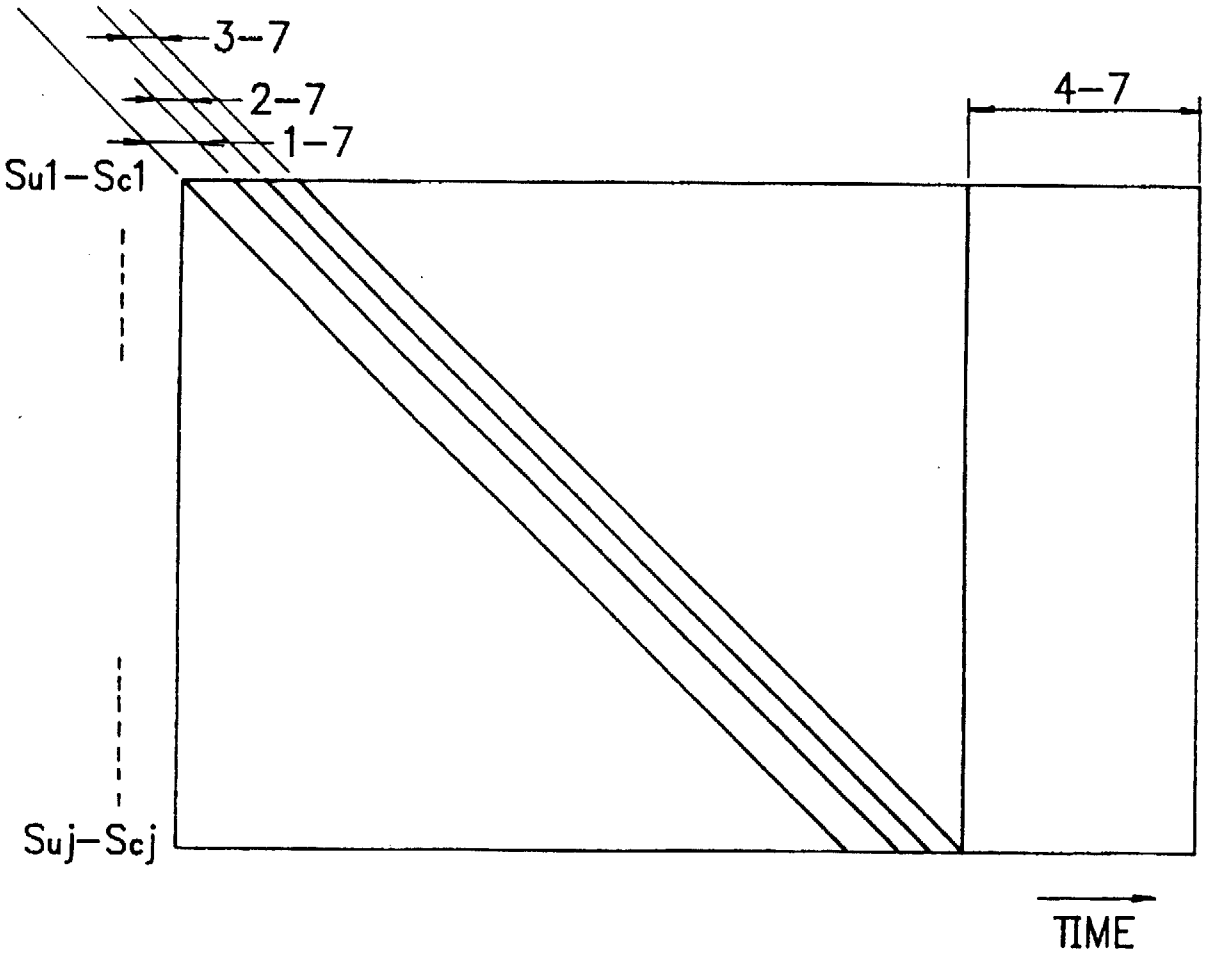
FIG. 11 is a schematic diagram chart showing partitions of a drive timing period in a fifth embodiment in accordance with the present invention.

Next, FIG. 11 schematically shows, as a fifth embodiment of the present invention, an internal configuration of a cycle of drive timing of the scanning operation for the pre-discharge in the PDP shown in FIG. 2.

In FIG. 11, there exists a pre-discharge period (1-7) in which for each scanning line, pre-discharge is simultaneously conducted for all display cells 8b (FIG. 2) on the scanning lines. Subsequent thereto is a pre-discharge erasing period (2-7) which is the object of the scanning and in which pre-discharge erasing is carried out for all display cells 8b on each scanning line. In a write discharge period (3-7) thereafter, a scanning pulse is applied to the scanning lines beginning at the first scanning line of the PDP 7b in a line sequential manner. In a sustaining discharge period (4-7) after the scanning pulse is finally applied to the last scanning line, display discharge is sustained in any pixel selected by the scanning and data pulses.

In FIG. 11, portions indicated by parallelograms are respectively associated with timing points of the pre-discharge, pre-discharge erasing, and write discharge, respectively. Through the operation above, there is attained a desired display image.

Figure 12:
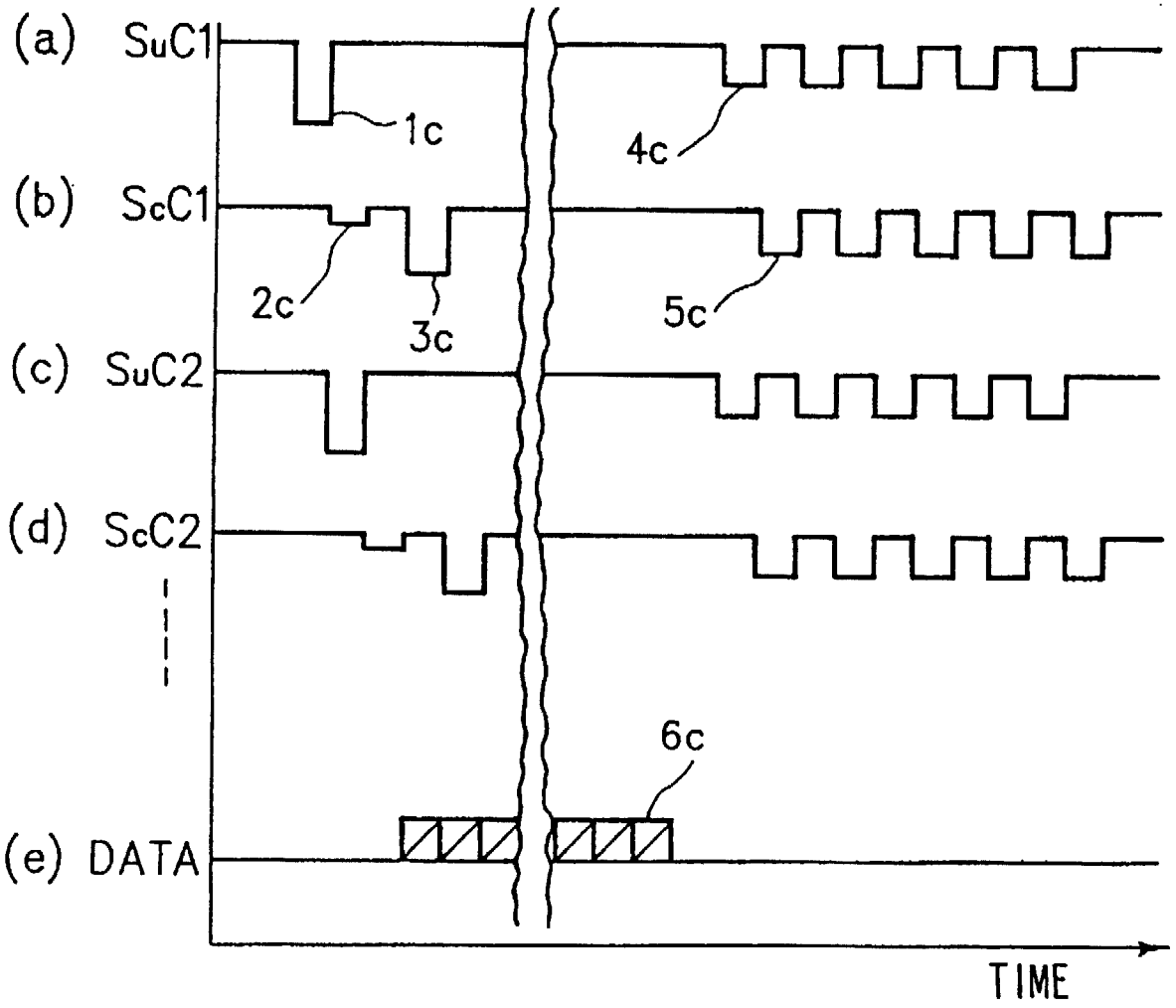
FIG. 12 is a signal timing chart showing an example of driving voltage waveforms in the fifth embodiment.

FIG. 12 is a signal timing chart showing an example of driving voltage waveforms in the fifth embodiment described above. In FIG. 12, portions (a) and (c) respectively show sustaining electrode driving waveforms SuC1 and SuC2 respectively applied to sustaining electrodes Su1 and Su2 of the PDP 7 shown in FIG. 2. Portions (b) and (d) respectively show scanning electrode driving waveforms ScC1 and ScC2 respectively applied to scanning electrodes Sc1 and Sc2 of FIG. 2. A portion (e) denotes data electrode driving waveform DATA applied to the data electrode Di ($1 \leq i \leq k$) of FIG. 2. A portion of a slant line in the waveform DATA indicates that the data pulse 6*c* is selected to the on or off state depending on presence or absence of data, respectively.

Paying attention, for example, to the first scanning line in FIG. 12, a pre-discharge pulse 1*c* is first applied to the sustaining electrode Su1 to simultaneously conduct pre-discharge for all display cells 8*b* (FIG. 2) on the first scanning line. Subsequently, a pre-discharge erasing pulse 2*c* is applied to the scanning electrode Sc1 to simultaneously achieve pre-discharge erasing for all display cells 8*b* on the first scanning line. Thereafter, a scanning pulse 3*c* is similarly applied to the scanning electrode Sc1. To write data in a display cell 8*b*, a data pulse 6*c* is applied thereto at the timing of the scanning pulse 3*c*. When the sequence of operations are finished for the last scanning line, sustaining pulses 4*c* and 5*c* are alternately applied to the all sustaining electrodes and the all scanning electrodes.

Figure 13:
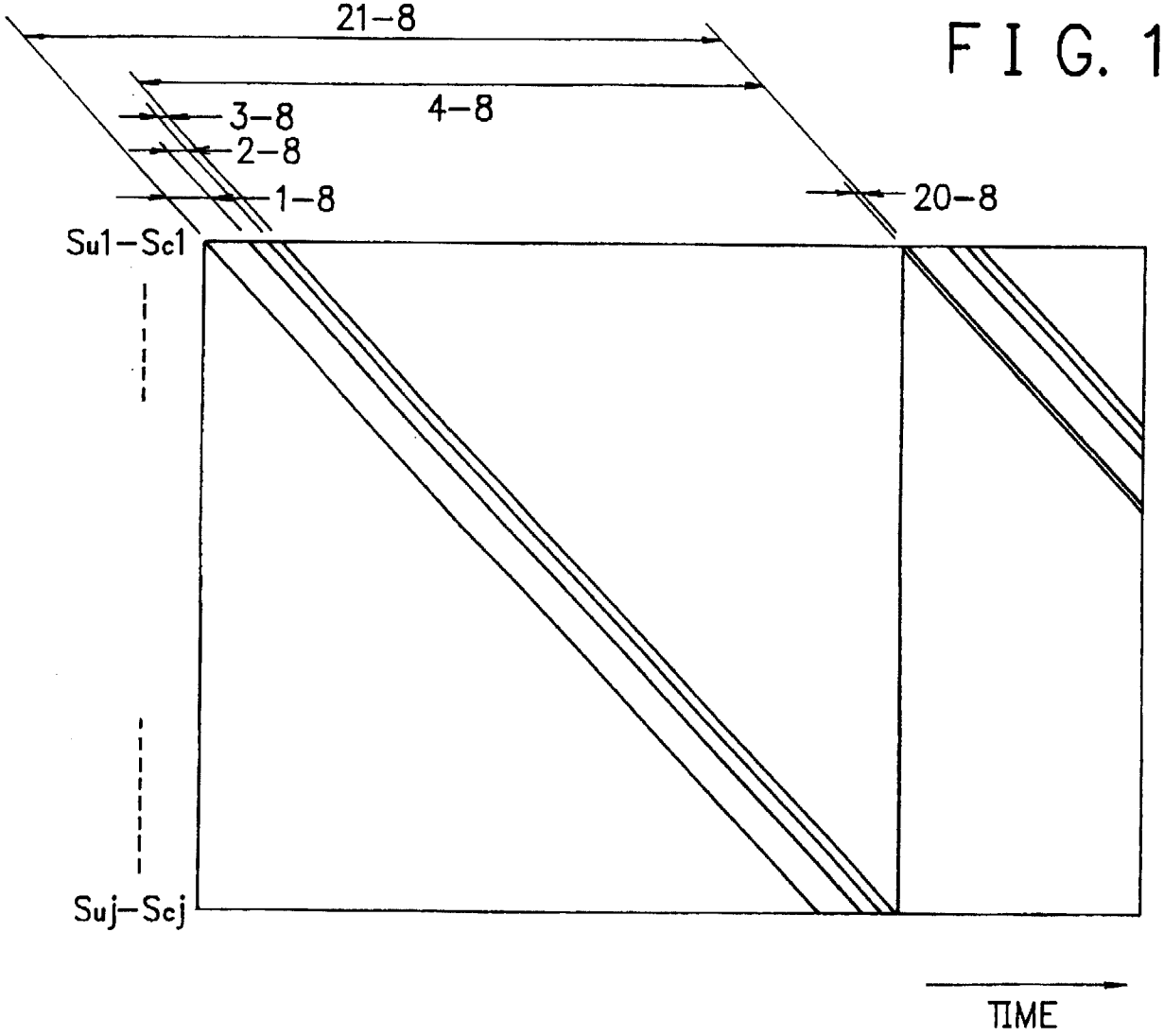
FIG. 13 is a schematic diagram chart showing partitions of a drive timing period in a sixth embodiment in accordance with the present invention.

Next, FIG. 13 schematically shows, as a fifth embodiment in accordance with the present invention, an internal structure of a cycle of drive timing in a case where the scanning is conducted for the pre-discharge, while the sustaining discharge and the scanning are effected in a mixed form in the PDP shown in FIG. 2.

In FIG. 13, there is provided a pre-discharge period (1-8) in which, for each scanning line, pre-discharge is simultaneously conducted for all display cells 8*b* (FIG. 2) on the scanning line. This period is followed by a pre-discharge erasing period (2-8) which is the object of the scanning and in which pre-discharge erasing is simultaneously carried out for all display cells 8*b* on each scanning line. In a write discharge period (3-8) thereafter, a scanning pulse is applied to the scanning lines beginning at the first scanning line of the PDP panel 7*b* in a line sequential manner.

In a pixel selected by the scanning and data pulses, display discharge is sustained in a sustaining discharge period (4-8) and then the sustaining discharge is erased finally during a sustaining discharge erasing period (20-8).

Incidentally, in the diagram of FIG. 13, portions indicated by parallelograms are respectively related to timing points of the pre-discharge, pre-discharge erasing, write discharge, sustaining discharge, and sustaining discharge erasing, respectively. As a result of the operation sequence in a sub-field (21-8), there is attained a desired display image.

Figure 14:
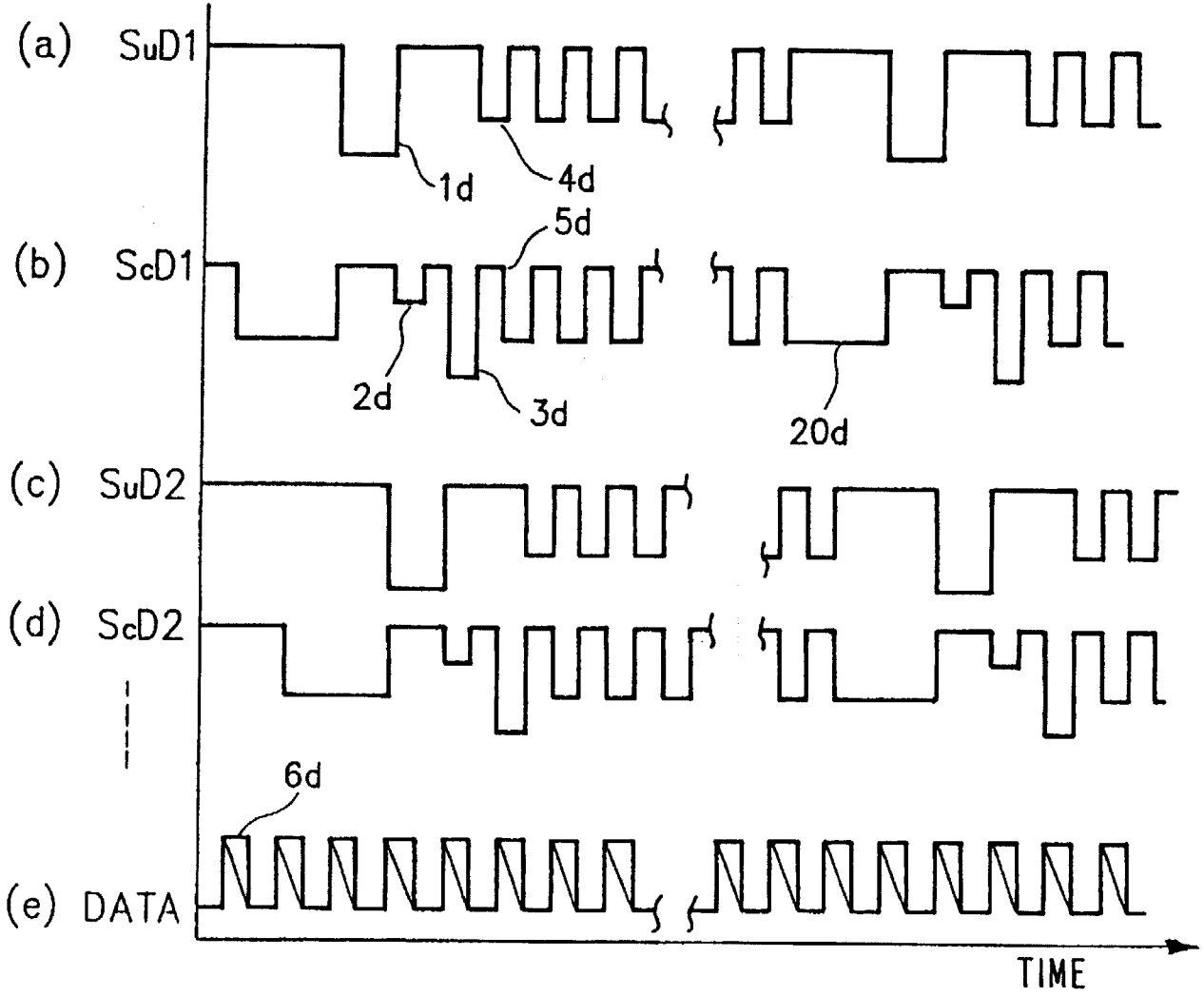
FIG. 14 is a signal timing chart showing an example of driving voltage waveforms in the sixth embodiment.

FIG. 14 is a signal timing chart showing an example of driving voltage waveforms in the sixth embodiment described above. In FIG. 14, portions (a) and (c) respectively stand for sustaining electrode driving waveforms SuD1 and SuD2 respectively applied to sustaining electrodes Su1 and Su2 of the PDP 7 shown in FIG. 2. Portions (b) and (d) respectively show scanning electrode driving waveforms ScD1 and ScD2 respectively applied to scanning electrodes Sc1 and Sc2 of FIG. 2. A portion (e) denotes a data electrode driving waveform DATA applied to the data electrode Di ($1 \leq i \leq k$) of FIG. 2. A portion of a slant line in the waveform DATA designates that the data pulse 6*d* is selected to the on or off state respectively depending on presence or absence of data.

In FIG. 14, paying attention, for example, to the first scanning line, a pre-discharge pulse 1*d* is first applied to the sustaining electrode Su1 to simultaneously conduct pre-discharge for all display cells 8*h* (FIG. 2) of the first scanning line. A pre-discharge erasing pulse 2*d* is then applied to the scanning electrode Sc1 to simultaneously achieve pre-discharge erasing for all display cells 8*b* on the first scanning line. Thereafter, a scanning pulse 3*d* is also fed to the scanning electrode Sc1. To write data in a display cell 8*b*, a data pulse 6*d* is applied thereto at the timing of the scanning pulse 3*d*. Sustaining pulses 4*d* and 5*d* are then alternately applied to the sustaining electrode Su1 and the scanning electrode Sc1 such that a sustaining discharge erasing pulse 20*d* is delivered to the scanning electrode Sc1.

When the sequence of operations are finished up to the last scanning line in a line sequential fashion, there is completely achieved a sub-field period (21-8) to display an image. In accordance with two embodiments described above, the scanning operation is accomplished through a set of operations associated with a pro-discharge period, a pre-discharge erasing period, and a write discharge period. However, to obtain a similar advantageous effect, the pre-discharge period may be commonly achieved such that the scanning operation is conducted lot the pre-discharge erasing period and the write discharge period. Although this configuration is slightly inferior in the operation speed to the above embodiments, since interference with respect to other lines is minimized, the operational stability is advantageously improved.

In the PDP driving method described above in which the scanning is carried out for a set including the pre-discharge, the pre-discharge erasing, and the write discharge, it is possible to considerably minimize the period of time from the pre-discharge or the discharge of pre-discharge erasing to the write pulse for all scanning lines regardless of the number thereof. For example, the period can be easily reduced to 20 μs or less, and even when the write pulse width is decreased to about 0.8 μs to 2 μs, there can be attained a satisfactory driving operation.

In the embodiments above, to obtain a satisfactorily stable write characteristic in a PDP having a large display capacity, the period of time from the discharge of pre-discharge erasing to the write pulse in each scan block is desirably set to 800 μs or less. When the period becomes equal to or more than this value, the advantageous feature of the present invention is regrettably unavailable. On the other hand, to increase the operation speed and to reduce the write voltage, the period is favorably set to 300 μs or less.

Furthermore, in the embodiments in accordance with the present invention, the scanning electrodes are classified into scan blocks each having an equal number of scanning electrodes. The present invention is not restricted by the embodiments, namely, the number of electrodes may vary between the respective scan blocks.

As above, to achieve a stable write discharge in a PDP of the ac discharge memory type, it is effective to conduct pre-discharge prior to write discharge as described in conjunction with the prior example. The effect of pre-discharge is developed according to optimization of wall charge on each electrode and residual of active particles (charged particles and excited particles) generated in the discharge space. The wall charge has a relatively long life, whereas the active particles are attenuated in a short period of time. In accordance with the present invention, thanks to provisions of the means described above, the problems of the prior art have been solved. That is, in accordance with the present invention, the period of time from the pre-discharge erasing to the write discharge is reduced by configuring electrodes in several blocks and by achieving a scanning operation of the pre-discharge and the pre-discharge erasing.

Figure 15:
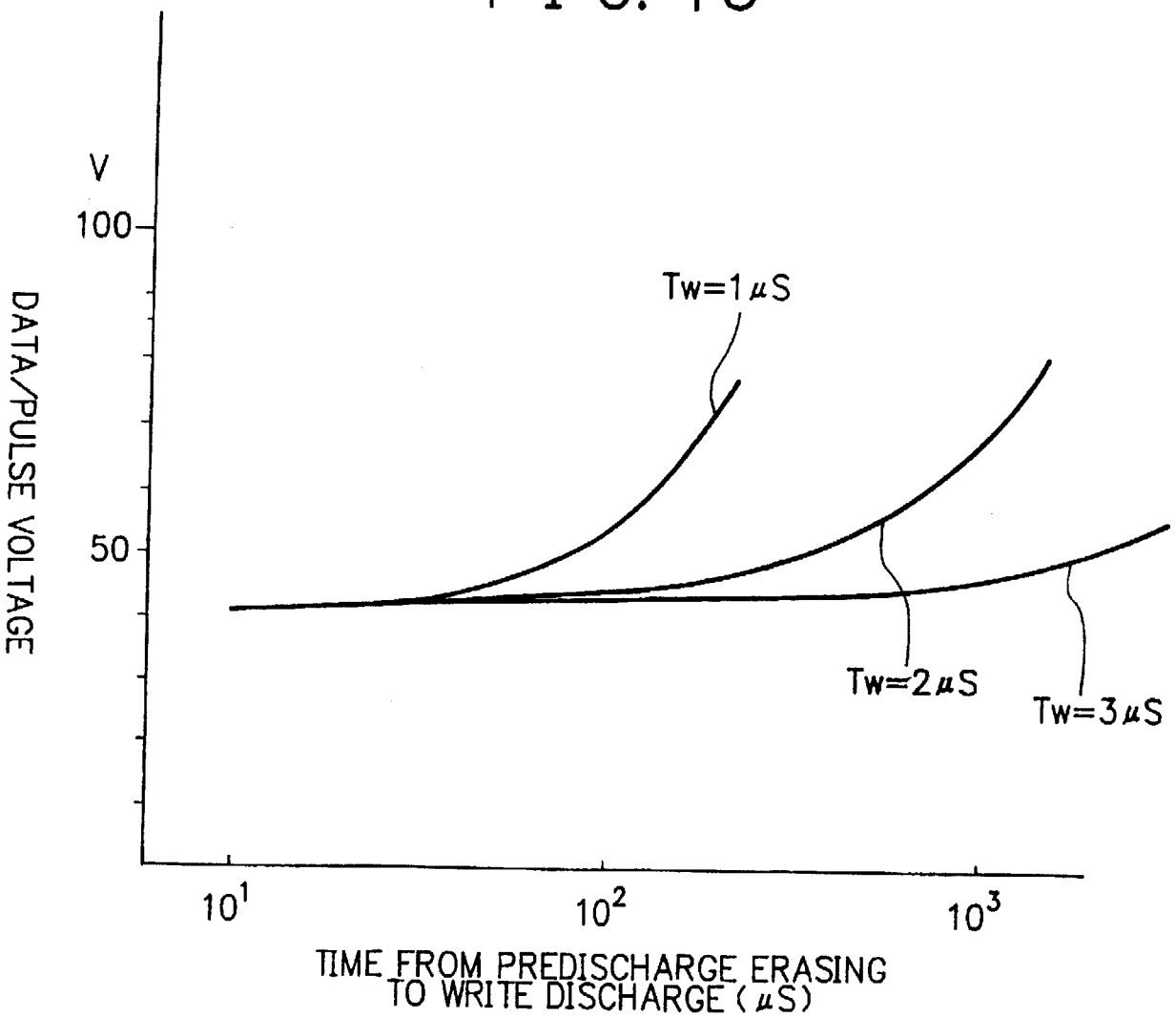
FIG. 15 is a diagram for explaining operation of the present invention.

Unlike the conventional method, the present method positively and efficiently employs active particles generated by the pre-discharge as seeds of the write discharge so as to achieve a high-speed write operation. In this method, the write discharge occurs in a state in which the cells are filled with active particles created by the pre-discharge or the pre-discharge erasing. Namely, there exist a sufficient number of seeds in the space, which prevents the write discharge voltage from being increased and hence leads to a stable and high-speed write operation. In addition, it is unnecessary to strictly control the wall charge, which has been indispensable in the conventional PDP driving method. As can be seen from FIG. 15, in areas in which the period from the pre-discharge erasing to the write discharge is respectively 500 μs, 200 μs, and 100 μs, even when the data pulse width is respectively 3 μs, 2 μs, and 1 μs, the write discharge can be effected without increasing the data pulse voltage. Appropriately controlling the period from the pre-discharge erasing to the write discharge as above, it is possible to increase the write operation speed, which is advantageously effective in driving a PDP having a large display capacity.

Figure 16:
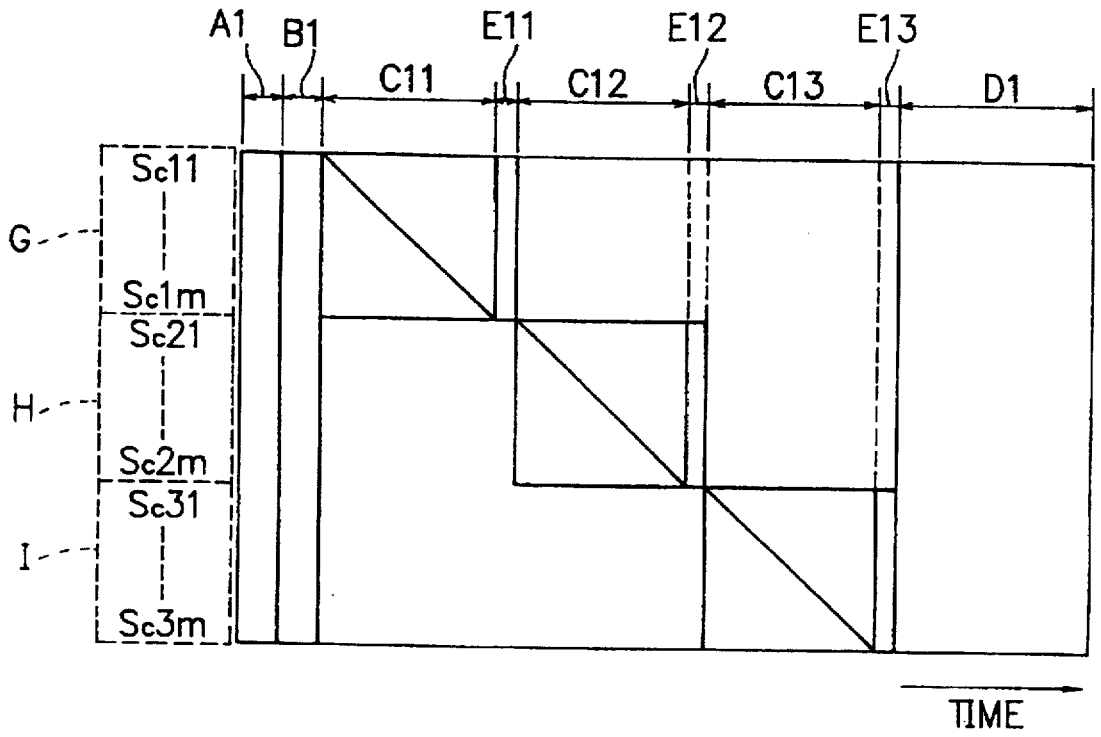
FIG. 16 is a schematic diagram showing drive timings of a seventh embodiment in accordance with the present invention.

Referring next to FIG. 16 schematically showing a cycle of the drive timing as a seventh embodiment of the PDP driving method in accordance with the present invention, in the driving method of the present invention, there is first provided a pre-discharge period A1 in which pre-discharge is effected for all display cells at the same time. Subsequent thereto is a pre-discharge erasing period B1 in which pre-discharge erasing is simultaneously carried out for all display cells. In a write discharge period C11 immediately thereafter, a write pulse is applied via the scanning electrode Sc11 in a line sequential manner as shown in FIG. 5.

Portions of slant lines correspond to write timing points of the respective scanning electrodes. There is disposed a first sustaining discharge period E11 for the following purpose. In the configuration, the scanning electrodes are subdivided into three groups (FIG. 16). When write discharge of the final scanning electrode Sc1m of the first block is terminated, namely, when a write operation is finished for the first scan block G, sustaining discharge is effected only for the first scan block G in the first sustaining discharge period E11. After this period E11 is terminated, write discharge is commenced for the subsequent second scan block H in a write discharge period C12, thereby repeatedly conducting a similar driving operation. There is provided a second sustaining discharge period D1 in which after a first sustaining discharge period E13 is completed for the last scan block, namely, third scan block I, sustaining discharge is simultaneously carried out for all scan blocks. Repeatedly achieving the driving sequence, there is attained a desired display image.

Figure 17:
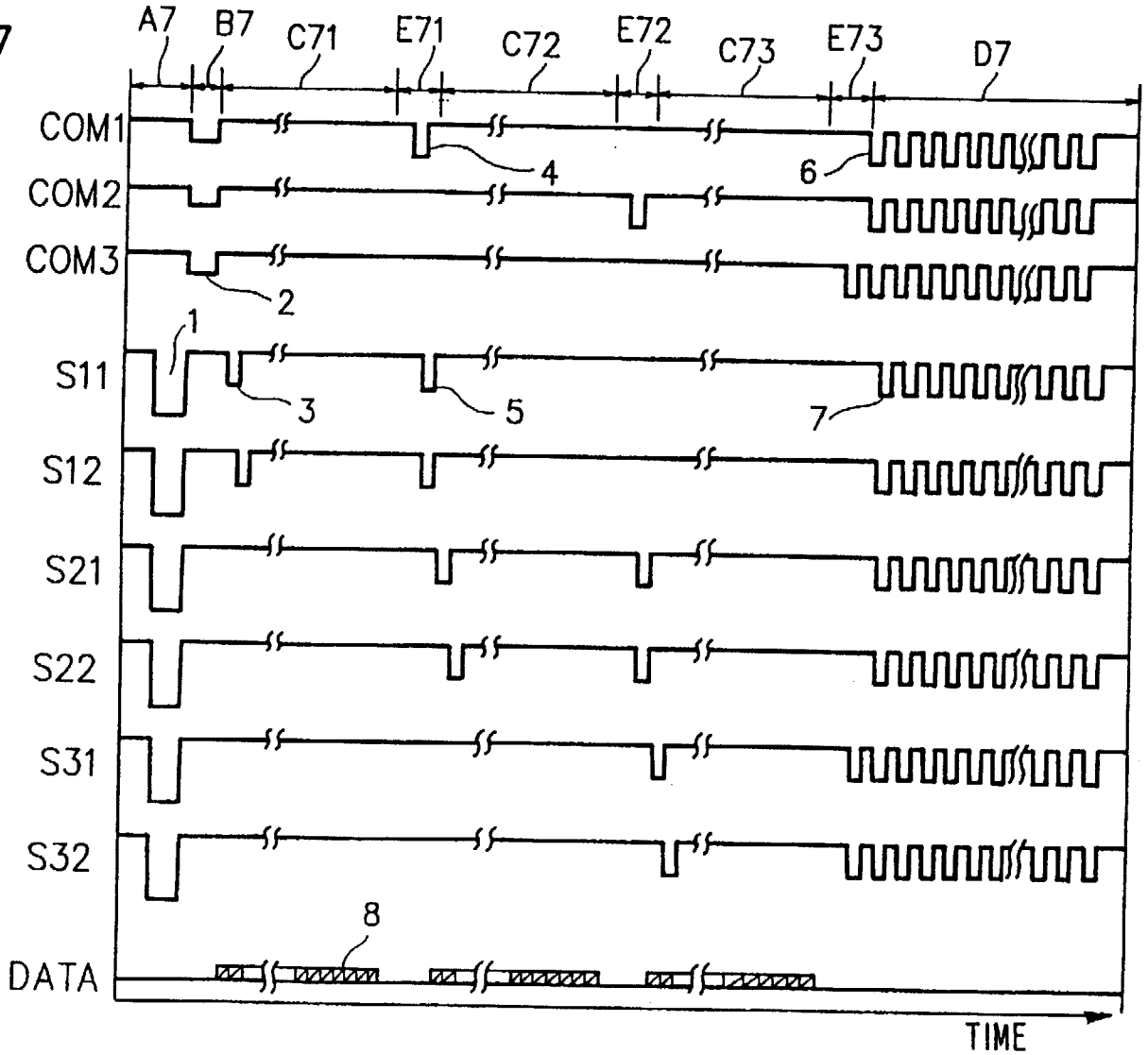
FIG. 17 is a signal timing chart showing an example of driving voltage waveforms of the seventh embodiment in accordance with the present invention.

FIG. 17 is a signal timing chart showing an example of driving voltage waveforms in the seventh embodiment. This chart includes sustaining electrode driving waveforms COM1, COM2, and COM3 commonly applied to the respective electrode blocks of the PDP panel of FIG. 5 including sustaining electrodes Su11 to Su1m of first scan block G. Su21 to Su2m of second scan block H, and Su31 to Su3m of third scan block I; Scanning electrode drive pulses S11 and S12, S21 and S22, and S31 and S32 respectively applied to scanning electrodes Sc11 and Sc12 of first scan block G, Sc21 and Sc22 of second scan block H, and Sc31 and Sc32 of third scan block I, and a data electrode driving waveform DATA applied to the data electrode Di ($1 \leqq i \leqq k$).

In a pre-discharge period A7, a pre-discharge pulse 1 is applied to all scanning electrodes. In a subsequent pre-discharge erasing period B7, a pre-discharge erasing pulse 2 is fed to all sustaining electrodes. Thereafter, in a write period of first scan block G, a scanning pulse 3 is applied to the scanning electrodes Sc11, Sc12, . . . , Sc1m in this order. When writing data in a (11-*i*)-th display cell 8*b*, a data pulse 8 is applied thereto at the timing of the scanning pulse 3 of the driving waveform S11 so as to cause discharge between the scanning electrode Sc11 and the data electrode Di. When data is not required to be written in the display cell (11-*i*), the data pulse 8 is not applied thereto.

After the write discharge is completed for the scanning electrode Sc1m, namely, a write discharge period C71 is finished, a sustaining pulse 4 is supplied to the sustaining electrodes Su11 to Su1m and then a sustaining pulse 5 is applied to the scanning electrodes Sc11 to Sc1m, thereby completely achieving a first sustaining discharge period E71 of first scan block G. Thereafter, scanning and first sustaining discharge are similarly conducted for second and third scan blocks H and I.

When the scanning and the first sustaining discharge are finished for all scan blocks according to the above sequence, there appears a second sustaining pulse period D7 in which sustaining pulses 6 and 7 are alternately applied to the sustaining electrodes Su11 to Su1m, Su21 to Su2m, and Su31 to Su3m and the scanning electrodes Sc11 to Sc1m, Sc21 to Sc2m, and Sc31 to Sc3m. When there are applied sustaining pulses of which the number matches the desired luminance of light illumination, the second sustaining pulse period D7 is terminated.

In the seventh embodiment described above, the first sustaining discharge is carried out at least once before the write operation is completed for the last scanning electrode so as to amplify wall charge which has a relatively low intensity and which has been generated by the write discharge.

Consequently, there can be remained a large amount of wall charge when the second sustaining discharge period is simultaneously initiated for all display cells. This hence facilitates transition to the second sustaining discharge and guarantees an increased of the voltage margin in the operation.

Figure 18:
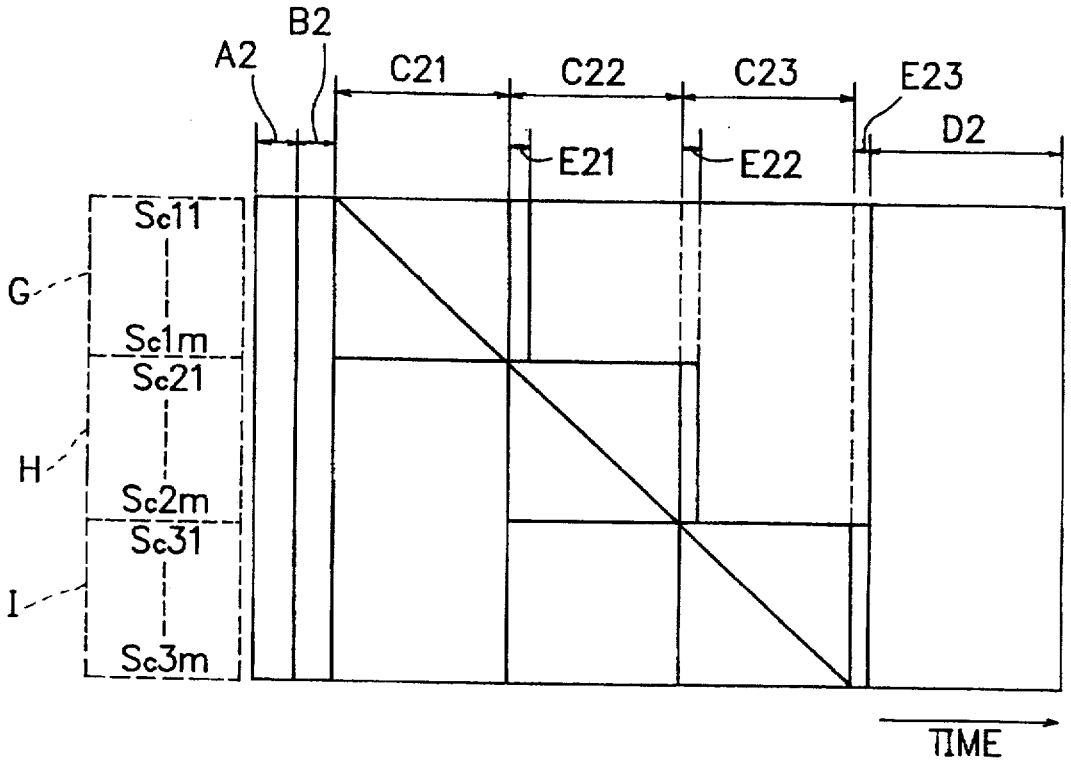
FIG. 18 is a diagram schematically showing drive timing of an eighth embodiment in accordance with the present invention.

Referring now to FIG. 18 schematically showing a cycle of the drive timing of an eighth embodiment of the PDP in accordance with the present invention, the PDP driving method of the present invention includes first a pre-discharge period A2 in which pre-discharge is simultaneously conducted for all display cells and a pre-discharge erasing period B2 subsequent to the period A2 in which pre-discharge erasing is carried out for all display cells at the same time.

This period B2 is followed by a write period C21 for first scan block G. A subsequent period E21, which is a first sustaining discharge period of first scan block G, overlaps with a write discharge period C22 of second scan block H. A similar driving operation is thereafter repeatedly conducted up to third scan block I. When a first sustaining discharge period E23 is finished for the final third scan block I, there is effected a second sustaining discharge period D2 in which sustaining discharge is conducted for all scan blocks at the same time.

In the eighth embodiment described above, like in the seventh embodiment, the characteristic difference of write discharge is minimized between the scanning electrodes to facilitate transition to the second sustaining discharge. Moreover, it is possible to reduce the period of time elapsed from the initial point of the driving operation to the end of the write discharge for all scanning lines.

Although a specific example of driving waveforms of the embodiment can be configured using a combination of the respective basic driving pulses of the seventh embodiment, description thereof will be avoided due to redundancy of explanation. This is also the case with the following ninth, tenth, eleventh, and twelfth embodiments.

Figure 19:
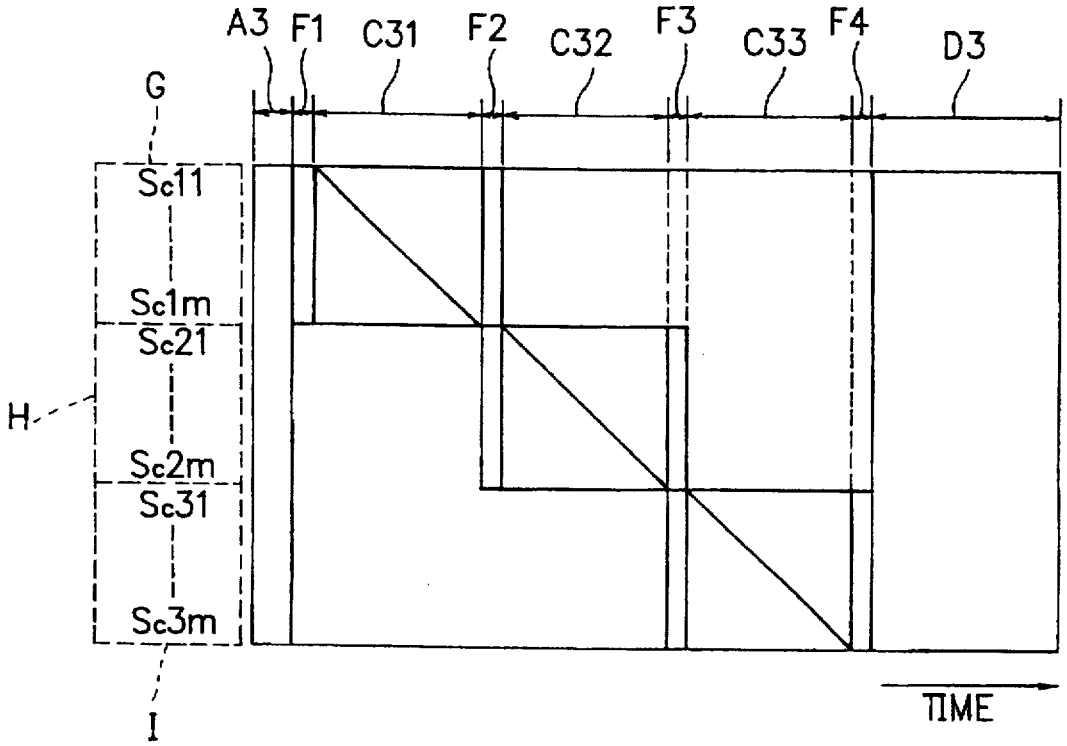
FIG. 19 is a schematic diagram showing drive timing of a ninth embodiment in accordance with the present invention.

Next, referring to FIG. 19 schematically showing a cycle of the drive timing of a ninth embodiment of the PDP in accordance with the present invention, the PDP driving method of the present invention includes first a pre-discharge period A3 in which pre-discharge is simultaneously conducted for all display cells. The period A3 is followed by a pre-discharge erasing period F1 of first scan block G and a write period C31 thereof. Subsequent thereto is a period F2 which is used simultaneously as a first sustaining discharge period of first scan block G and a pre-discharge erasing period of second scan block H. In consequence, sustaining discharge of first scan block G and pre-discharge erasing of second scan block H are carried out at the same time. Next, in a write discharge period C32, write discharge is commenced for second scan block H. The driving operation is similarly accomplished up to third scan block I. When a first sustaining discharge period F4 is finally finished for the third scan block I, there is effected a second sustaining discharge period D3 in which sustaining discharge is simultaneously conducted for all scan blocks.

In accordance with the ninth embodiment described above, since the maximum time discrepancy between the pre-discharge erasing and the write discharge is decreased, it is possible to minimize the characteristic difference of write discharge between the scanning electrodes due to annihilation of active particles after the pre-discharge erasing.

In addition, prior to termination of the write operation for the last scanning electrode, since the first sustaining discharge is accomplished at least once to amplify the relatively low wall charge created by the write discharge, a large amount of residual wall charge can be kept retained when the second sustaining discharge period is initiated for all display cells. This consequently facilitates transition to the second sustaining discharge and leads to an improved voltage margin in the operation.

Figure 20:
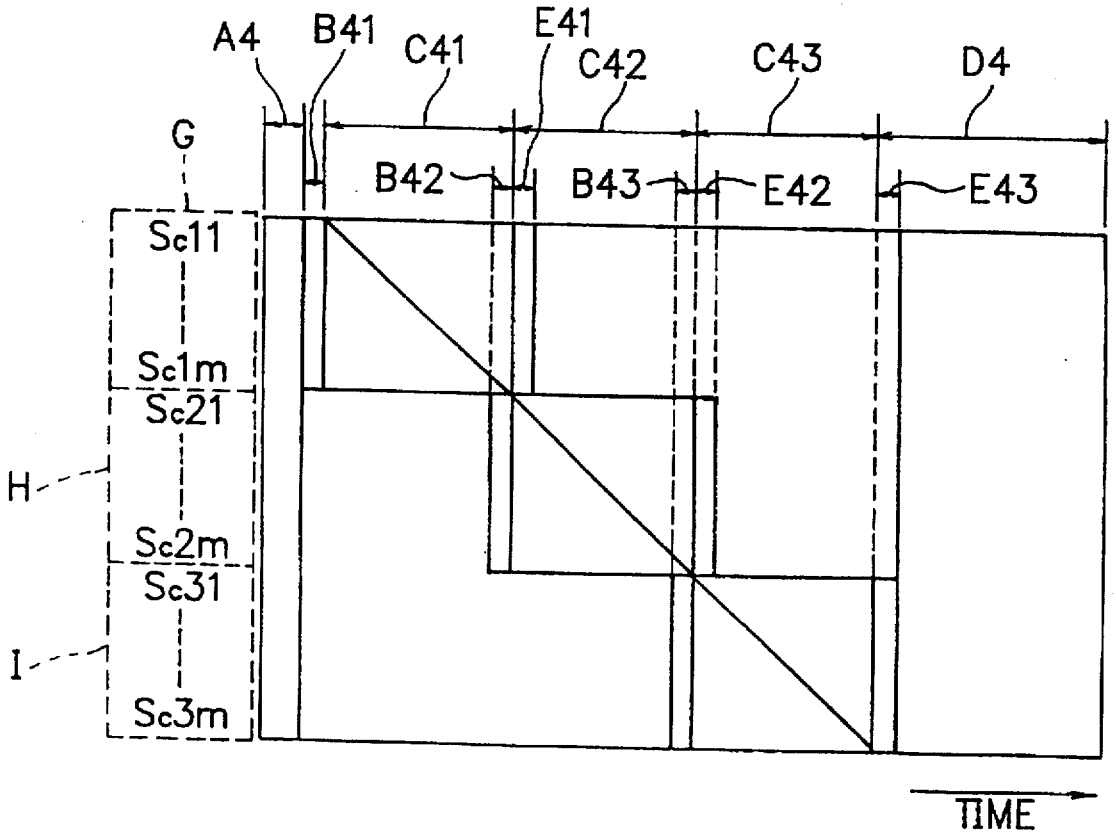
FIG. 20 is a diagram schematically showing drive timing of a tenth embodiment in accordance with the present invention.

Referring now to FIG. 20 schematically showing a cycle of the drive timing of a tenth embodiment of the PDP in accordance with the present invention, the PDP driving method of the present invention includes first a pre-discharge period A4 in which pre-discharge is simultaneously conducted for all display cells. This is followed by a subsequent pre-discharge erasing period B41 of first scan block G and a write period C41 thereof. During the write discharge period of first scan block G, a pre-discharge erasing period B42 of second scan block H is started such that write discharge of first scan block G and pre-discharge erasing of second scan block H are terminated at the same time. Write discharge of second scan block H is initiated immediately after the write discharge period C41 of first scan block G. In the initial stage of the write discharge period, first sustaining discharge of first scan block is simultaneously executed in a period E41. The driving operation is repeatedly achieved up to third scan block I in a similar manner. When a first sustaining discharge period E43 is finally completed for the third scan block I, there appears a second sustaining discharge period D4 in which sustaining discharge is simultaneously conducted for all scan blocks.

In the tenth embodiment described above, like in the ninth embodiment, the characteristic difference of write discharge is minimized between the scanning electrodes to facilitate transition to the second sustaining discharge. Furthermore, it is possible to reduce the period of time elapsed from the starting point of the driving operation to the end of the write discharge for all scanning lines.

Figure 21:
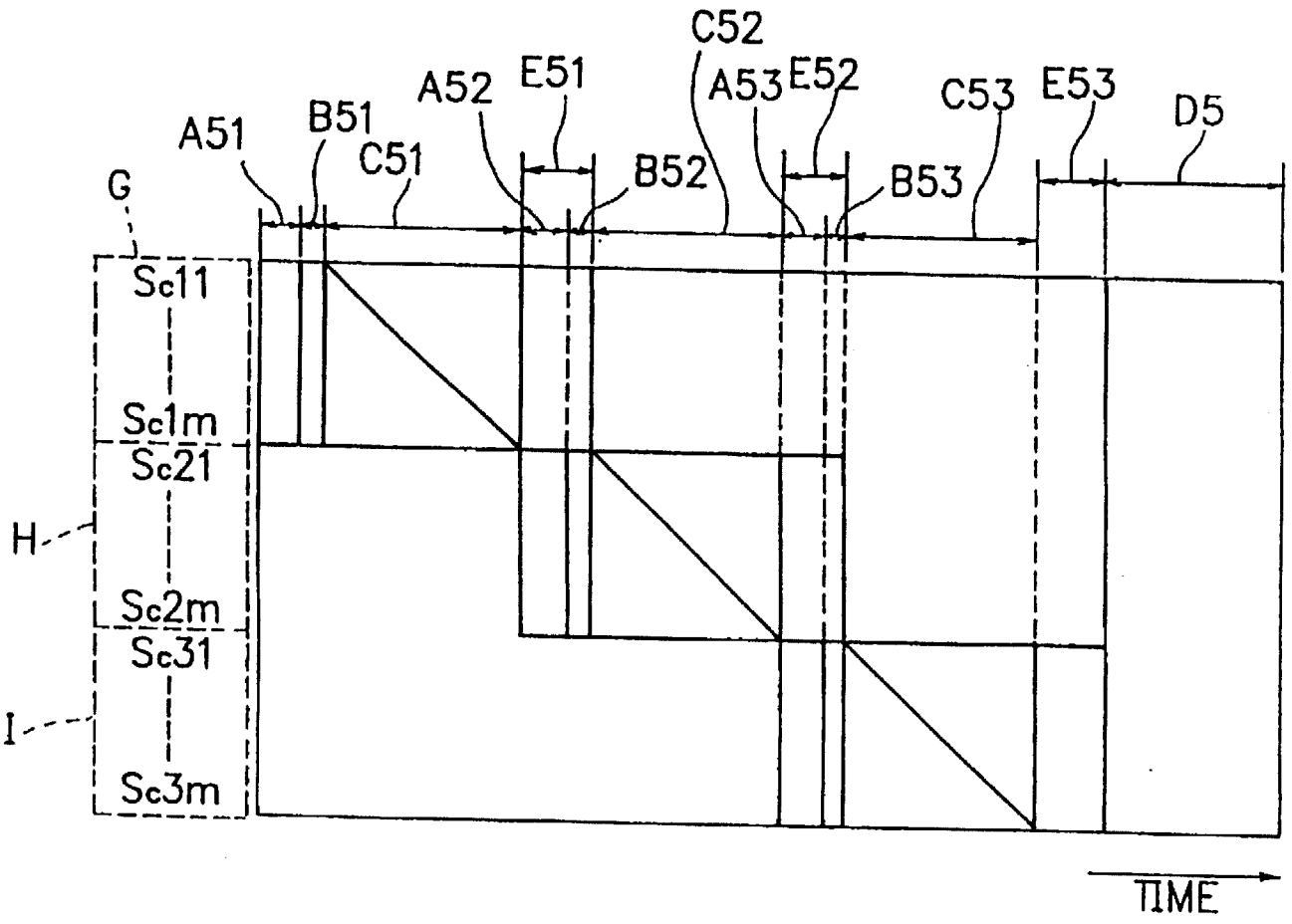
FIG. 21 is a schematic diagram showing drive timing of an 11-th embodiment in accordance with the present invention.

Subsequently, referring to FIG. 21 schematically showing a cycle of the drive timing of an eleventh embodiment of the PDP in accordance with the present invention, the PDP driving method of the present invention first includes a pre-discharge period A51 only of first scan block G, a pre-discharge erasing period B51 subsequent thereto, and a write period C51 thereof. A period E51 following the period C51 is simultaneously used as a pre-discharge period A52 and a pre-discharge erasing period B52 for second scan block H. Consequently, sustaining discharge of first scan block G and pre-discharge and pre-discharge erasing of second scan block H are conducted at the same time. Next, write discharge of second scan block H is started in the write discharge period C52. Similarly, the driving operation is repeatedly accomplished up to third scan block I. When a first sustaining discharge period E53 is finally terminated for the third scan block I, there is effected a second sustaining discharge period D5 in which sustaining discharge is simultaneously conducted for all scan blocks.

In the eleventh embodiment described above, it is possible to decrease the characteristic difference of write discharge between the scanning electrodes due to reduction of active particles after the pre-discharge erasing so as to facilitate transition to the second sustaining discharge. Additionally, the period of time elapsed from the starting point of the driving operation to the end of the write discharge for all scanning lines is reduced. Consequently, it is possible to decrease the characteristic difference of pre-discharge erasing between the scanning electrode blocks.

In addition, before termination of the write operation for the last scanning electrode, the first sustaining discharge is accomplished at least once to amplify the relatively low wall charge created by the write discharge. In consequence, a large amount of residual wall charge can be kept remained up to when the second sustaining discharge period is initiated for all display cells. This consequently facilitates transition to the second sustaining discharge and guarantees increase in the voltage margin in the operation.

Figure 22:
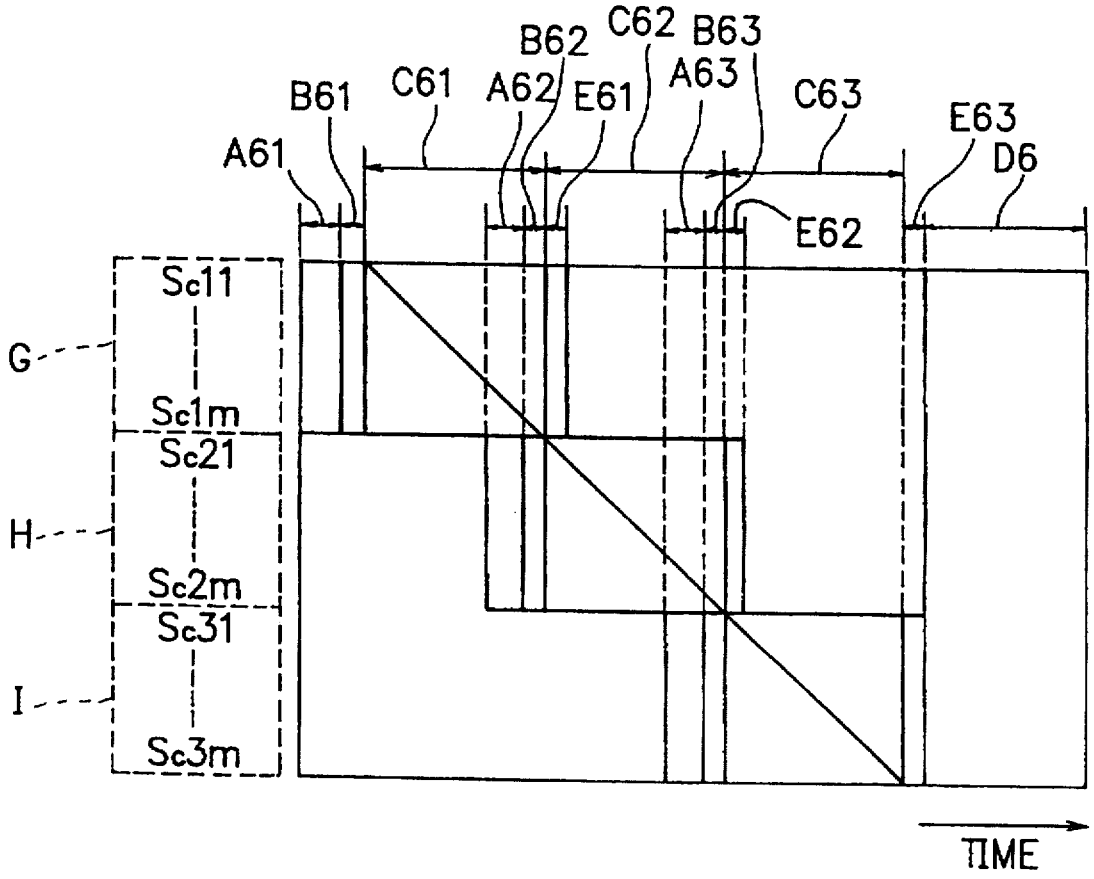
FIG. 22 is a schematic diagram showing drive timing of a 12-th embodiment in accordance with the present invention.

Referring next to FIG. 22 illustratively showing a cycle of the drive timing of a twelfth embodiment of the PDP in accordance with the present invention, the PDP driving method of the present invention includes first a pre-discharge period A61 only for first scan block G, a pre-discharge erasing period B61 subsequent thereto, and a write period C61 thereof. A pre-discharge period A62 and a pre-discharge erasing period B62 of second scan block H overlap with a write period C61 of first scan block G. A period E61 subsequent thereto, which is the first sustaining discharge period of first scan block G, overlaps with a write period C62 of second scan block H. The driving operation is repeatedly achieved up to third scan block I in a similar manner, when a first sustaining discharge period E63 is finally completed for third scan block I, there appears a second sustaining discharge period D6 in which sustaining discharge is simultaneously conducted for all scan blocks.

In the twelfth embodiment described above, like in the eleventh embodiment, there can be minimized the characteristic difference of write discharge between the scanning electrodes due to reduction of active particles after the pre-discharge erasing as well as the characteristic discrepancy of the pre-discharge erasing between the scanning electrode blocks. This further facilitates transition to the second sustaining discharge. Moreover, the period of time elapsed from the starting point of the driving operation to the end of the write discharge for all scanning lines can be reduced.

Moreover, according to the embodiments described above, the sustaining pulse 4 of first sustaining discharge and the sustaining pulse 6 of second sustaining discharge may be of the same voltage and pulse width. However, to increase intensity of first sustaining discharge so as to further facilitate transition from first sustaining discharge to second sustaining discharge, there may be efficiently employed a sustaining pulse 4 having a voltage or a pulse width larger than that of the sustaining pulse 6.

Figure 23:
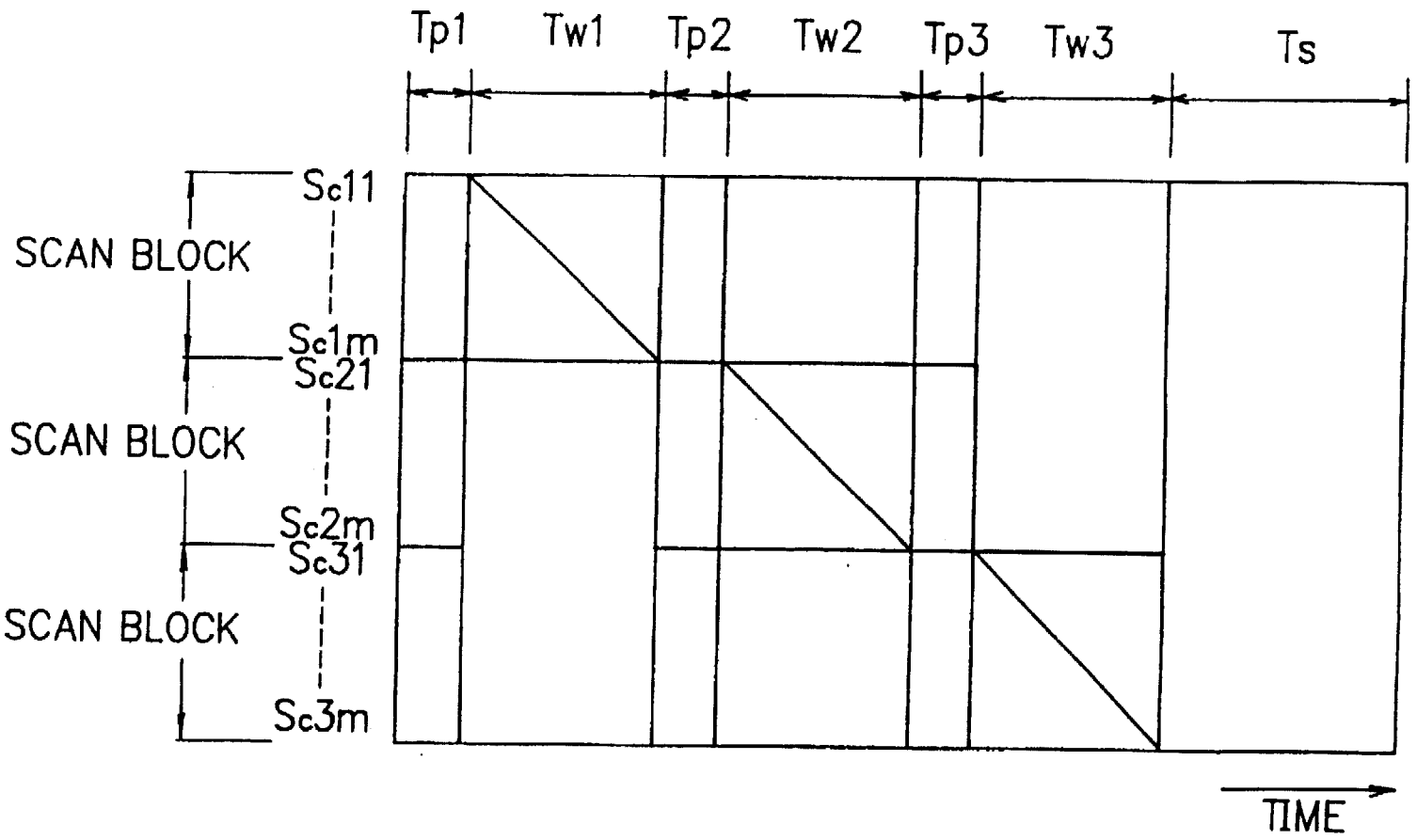
FIG. 23 is a schematic diagram showing partitions of a drive timing period of a 13-th embodiment in accordance with the present invention.

Next, FIG. 23 schematically shows an internal configuration of a cycle of the drive timing as a thirteenth embodiment of the PDP driving method in accordance with the present invention. In this example, all scanning lines are classified into three blocks including scan block 1 to 3.

According to FIG. 23, in a pre-discharge period Tp1, pre-discharge is conducted simultaneously for all display cells of scan block 1 which is the first block obtained by dividing the scanning lines into blocks, and then pre-discharge erasing is effected for all display cells of scan block 1 at the same time. The pre-discharge period of scan block 1 is also used as a sustaining discharge period of scan blocks 2 and 3.

Subsequently, in a write discharge period Tw1 of scan block 1, a write pulse is applied to the scanning lines beginning at the first scanning line of block 1 in a line sequential fashion. In FIG. 23, portions indicated by slant lines correspond to write timing points of the respective scanning lines.

In a pre-discharge period Tp2 after the write operation is finished in scan block 1, pre-discharge is simultaneously carried out for all display cells of scan block 2 and then pre-discharge erasing is achieved for all display cells of scan block 2 at the same time. The pre-discharge period of scan block 2 is also utilized as a sustaining discharge period of scan blocks 1 and 3.

In the above operation, the sustaining discharge of scan block 1 is first accomplished after the write discharge, namely, the first sustaining discharge. Moreover, the sustaining discharge of scan block 3 is the third sustaining discharge which is neither the first sustaining discharge after the write discharge nor is the sustaining discharge (second sustaining discharge) common to all scan blocks.

Thereafter, the drive scanning is repeatedly conducted in a similar manner. When the write period of the last scan block 3 is completed, sustaining discharge (second sustaining discharge) is simultaneously accomplished for all scan blocks in period Ts.

Repetitiously conducting the drive sequence, there is obtained a desired display image.

Figure 24:
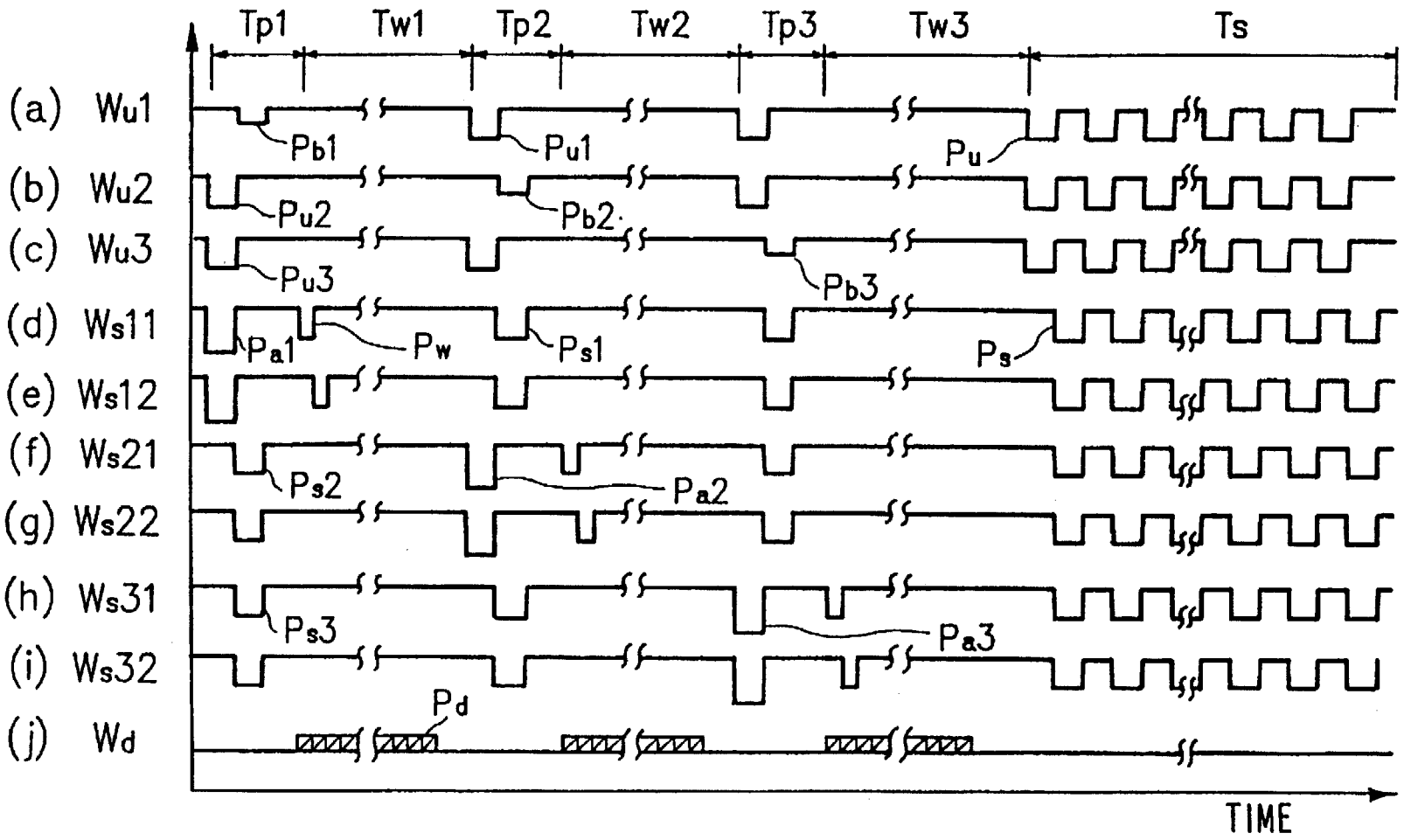
FIG. 24 is a signal timing chart schematically showing a first example of driving voltage waveforms of the 13-th embodiment in accordance with the present invention.

FIG. 24 is a signal timing chart showing a first example of driving voltage waveforms in the 13th embodiment. Portions (a) to (c) of FIG. 24 respectively indicate sustaining electrode driving waveforms Wu1, Wu2, and Wu3 commonly applied to the respective scan blocks of the PDP shown in FIG. 5, namely, to the sustaining electrodes Su11 to Su1m of scan block 1, Su21 to Su2m of scan block 2, and Su31 to Su3m of scan block 3. Portions (d) and (e), (f) and (g), and (h) and (i) respectively denote scanning electrode driving waveforms Ws11 and Ws12, Ws21 and Ws22, and Ws31 and Ws32 respectively applied to the scanning electrodes Sc11 to Sc1m of scan block 1, Sc21 to Sc2m of scan block 2, and Sc31 to Sc3m of scan block 3. A portion (j) shows a data electrode driving waveform Wd applied to the data electrode Di ($1 \leqq i \leqq k$). In the waveform Wd, a slant line designates that the data pulse is selected to the on or off state depending on presence or absence of data, respectively.

In the pre-discharge period Tp1 of scan block 1, a pre-discharge pulse Pa1 is delivered to all scanning electrodes of scan block 1 and then a pre-discharge erasing pulse Pb1 is fed to all sustaining electrodes thereof. During the pre-discharge period of scan block 1, sustaining pulses Pu2 and Pu3 and Ps2 and Ps3 are respectively applied to the sustaining electrodes in scan blocks 2 and 3, respectively. Namely, sustaining discharge is effected for display cells selected during the write period of the preceding field.

Thereafter, in the write discharge period Tw1 of scan block 1, a scanning pulse Pw is applied to the scanning electrodes Sc11, Sc12, . . . , Sc1m in this order. When writing data in the (11-*i*) display cell, a data pulse Pd is applied thereto at the timing of a scanning pulse Pw such that discharge takes place between the scanning electrode Sc11 and the data electrode Di. When the write operation is not desired in the (11-*i*) display cell, the data pulse Pd is not applied thereto.

When the scanning is finished for the scanning electrode Sc1m, namely, when the write discharge is completed, pre-discharge and pre-discharge erasing are sequentially carried out for scan block 2. Concurrently, sustaining discharge is also achieved for scan blocks 1 and 3. In scan block 1, sustaining discharge is conducted in display cells selected in the previous write period. In scan block 3, display cells selected in the preceding field are kept sustained for operation.

Similarly, scanning of scan block 2, pre-discharge and pre-discharge erasing of scan block 3, sustaining discharge of scan blocks 1 and 2, and scanning of scan block 3 are sequentially carried out.

After the scanning is completely effected for the final scan block 3, there appears a sustaining pulse period Ts in which sustaining pulses Pu and Ps are alternately and commonly applied to the scanning electrodes Su11 to Su1m, Su21 to Su2m, and Su31 to Su3m and the scanning electrodes Sc11 to Sc1m, Sc21 to Sc2m, and Sc31 to Sc3m, respectively. The sustaining pulse period Ts is terminated when the number of applied sustaining pulses suffices the required luminance of light illumination. The number of pulses in the period Ts can be obtained as the difference between total a number of sustaining pulses and the value of pulse count in the sustaining discharge concurrent to the pre-discharge before the period Ts and that after the period Ts. This advantageously minimizes the sustaining period when compared with the prior art.

To guarantee the pre-discharge, when the pre-discharge pulse voltage is increased, separation between the discharge spaces of the respective scan blocks becomes insufficient. In the pre-discharge period, there occurs discharge due to the potential difference caused by the pre-discharge pulse in a display line of a block not to be subjected to the pre-discharge, the display line being adjacent to the pre-discharge, block. This disturbs the state of charge after the write operation and/or causes unstableness in the sustaining discharge depending on cases.

Means of solving the above problem will now be described by paying attention to the pre-discharge period Tp2 of scan block 2 in the embodiment shown in FIG. 24.

The scanning electrode Sc21 (related to the driving waveform Ws21) of scan block 2 to which the pre-discharge pulse Pa2 is applied is adjacent to the sustaining electrode Su1m of scan block 1. At the timing of the pre-discharge pulse Pa2, the sustaining pulse Pu1 is being applied to the sustaining electrode Su1m (related to the driving waveform Wu1). As can be seen from the diagram, the sustaining pulse Pu1 is in phase with the pre-discharge pulse Pa2.

In general, to guarantee discharge, the pre-discharge pulse voltage is required to be higher than the sustaining pulse voltage. However, when a voltage pulse of which the voltage is substantially equivalent to the sustaining voltage is applied in the in-phase state, the potential difference between the electrodes due to the pre-discharge pulse voltage can be reduced to be less than the discharge starting voltage.

Consequently, it is possible in the pre-discharge to minimize movement or transfer of charge between the scanning electrode Sc21 and the sustaining electrode Su1m adjacent thereto, thereby preventing at least occurrence of discharge therebetween.

On the other hand, to the scanning electrode Sc31 (related to the driving waveform Ws31) of scan block 3 adjacent to the sustaining electrode Su2m (related to the driving waveform Wu2) on the remaining end of scan block 2, the pre-discharge erasing pulse Pb2 and the sustaining pulse Ps3 are applied in the in-phase state. The discharge initiating voltage cannot be exceeded even only by the sustaining pulse Ps3 and hence discharge is not started. In this case, moreover, there is applied the pre-discharge erasing pulse Pb2 to much more reduce the potential difference between the electrodes, which hence minimizes movement of electric charge therebetween.

Figure 25:
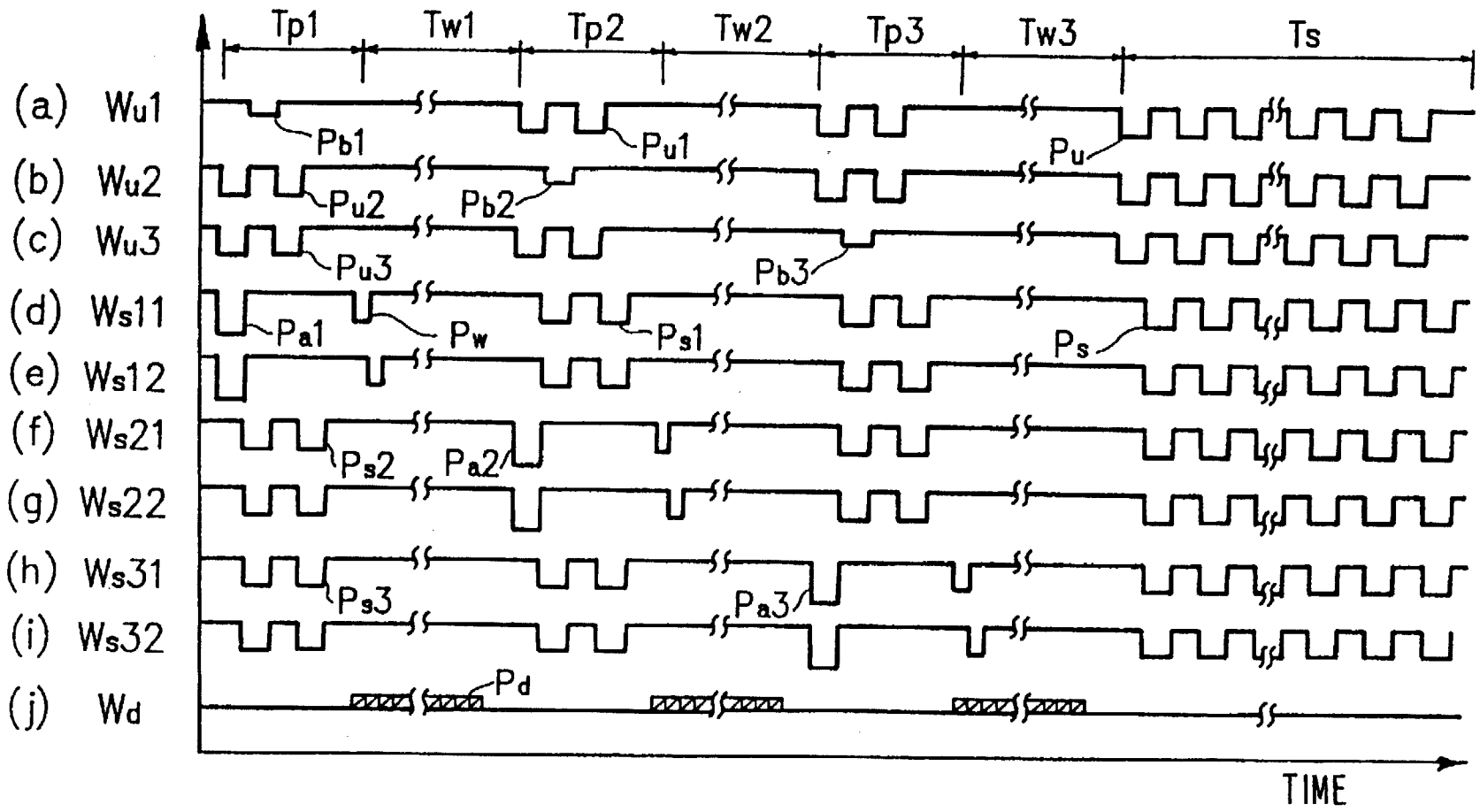
FIG. 25 is a signal timing chart showing a second example of driving voltage waveforms of the 13-th embodiment in accordance with the present invention.

FIG. 25 is a signal timing chart showing a second example of driving voltage waveforms in the 13th embodiment.

Although the basic driving sequence is similar to that of the first example shown in FIG. 24, the number of sustaining pulses in the sustaining discharge period concurrent to the pre-discharge period is increased as compared with the first example. Also after the pre-discharge erasing pulse is completed, the sustaining discharge is kept continued for a fixed period of time before the write operation is initiated.

According to this example, in a case where a fixed period of time is required for active particles in display cells after pre-discharge to develop a stable effect for write discharge, sustaining discharge is continued for other scan blocks in the fixed period of time so as to improve the utilization ratio with respect to time.

Figure 26:
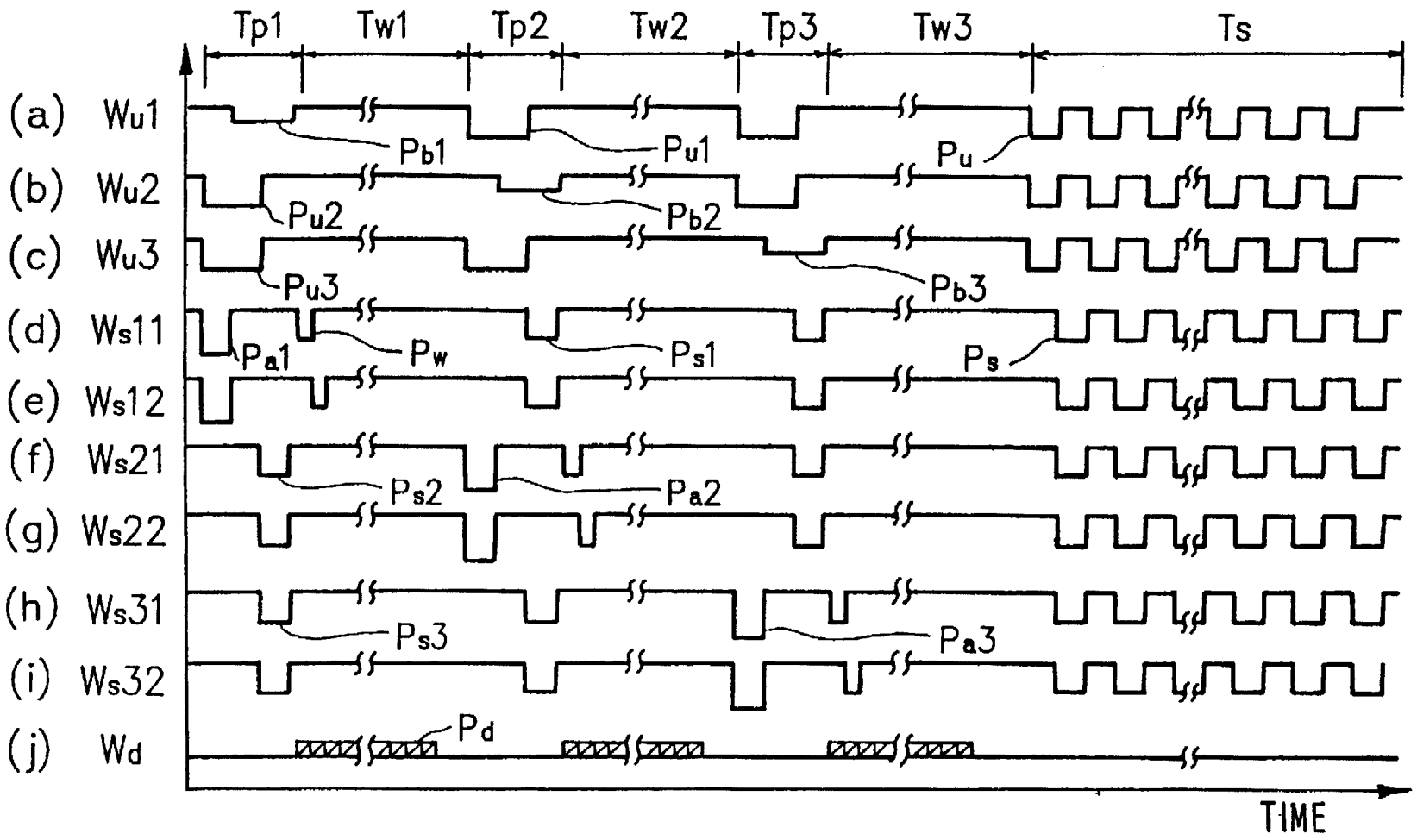
FIG. 26 is a signal timing chart showing a third example of driving voltage waveforms of the 13-th embodiment in accordance with the present invention.

Furthermore, FIG. 26 shows a third example of driving voltage waveforms in the 13th embodiment. In this example, discharge is prevented in the scan block boundary during the pre-discharge period.

Since the fundamental driving sequence is substantially the same as that of the first example shown in FIG. 24, description will be given of only the driving operation in the pre-discharge period primarily in consideration of the pre-discharge period Tp2.

The sustaining pulse Pu1 is applied to the sustaining electrode Su1m (related to the driving waveform Wu1) such that the application period of the pulse Pu1 overlaps with those of the pre-discharge pulse Pa2 to the scanning electrode Sc21 (related to the driving waveform Ws21) of scan block 2 and the pre-discharge erasing pulse Pb2 to the sustaining electrode Su21 (related to the driving waveform Wu2) of scan block 2. As shown in FIG. 26, the sustaining pulse Pu1 has in phase state with the pre-discharge pulse Pa2 and the pre-discharge erasing pulse Pb2.

Since the in-phase pulse is applied during the pre-discharge pulse applying period of scan block 2, the discharge is prevented during both of the pre-discharge and pre-discharge erasing operations.

On the other hand, as for the scanning electrode Sc31 (driving waveform Ws31) of scan block 3 adjacent to the sustaining electrode Su2m (driving waveform Wu2) on the remaining end of scan block 2, the discharge starting voltage cannot be exceeded only by applying the sustaining pulse Ps3 to the scanning electrode Sc31 and hence the discharge is not caused. The pre-discharge erasing pulse Pb2 applied to the sustaining electrode Su2m decreases the potential discrepancy between the electrodes, which consequently minimizes transfer of charge.

Figure 27:
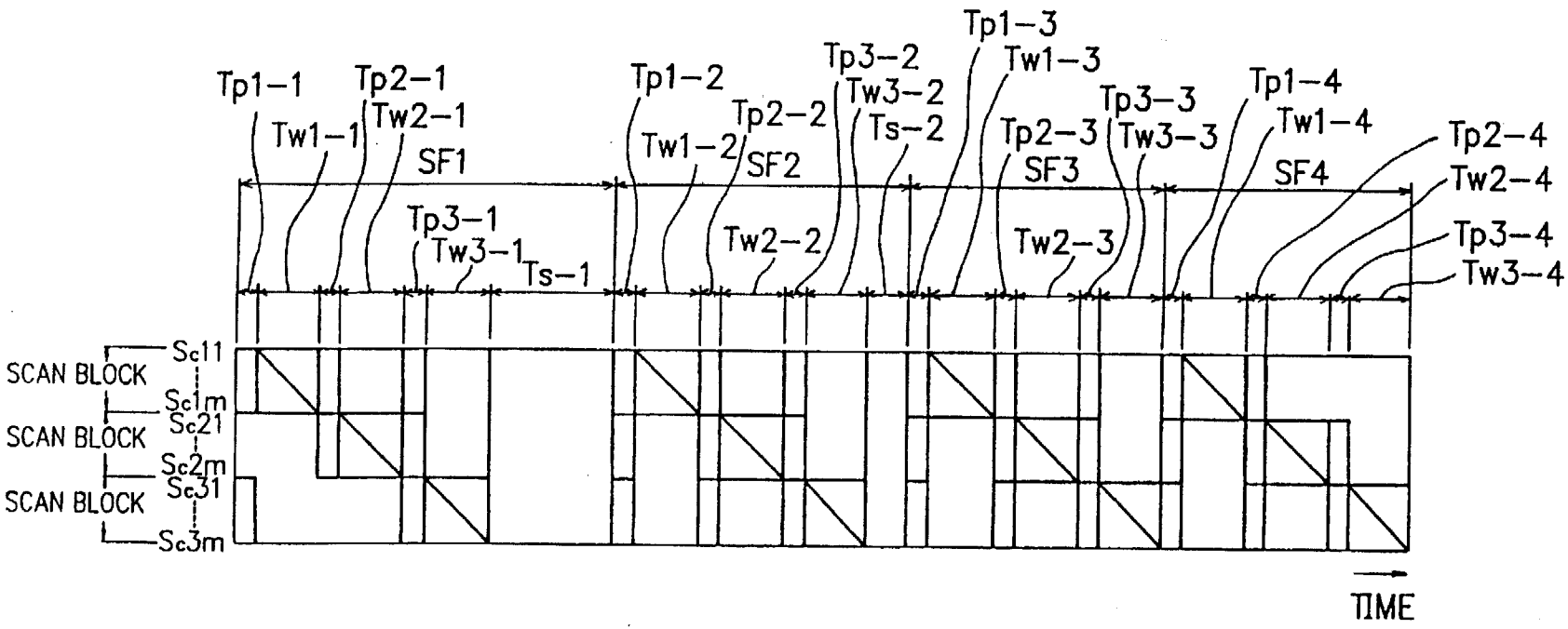
FIG. 27 is a schematic diagram showing partitions of a drive timing period of a 14-th embodiment in accordance with the present invention.

Subsequently, FIG. 27 schematically shows the internal configuration of a cycle of the drive timing in a 14th embodiment in accordance with the present invention.

In this embodiment, each frame includes four sub-fields SF1 to SF4 between which the number of sustaining discharges varies. In each subfield, the methods of pre-discharge, pre-discharge erasing, and scanning of each scan block are substantially the same as those of the embodiment shown in FIG. 23.

In the sustaining discharge, the number of discharges is varied for each sub-field to change luminance of light illumination. For a display cell undergone write discharge in the sub-field SF1, paying attention to scan block 1, the magnitude of luminance is decided according to the total of numbers of sustaining discharges in periods TP2-1, TP3-1, and TS-1.

Next, for a display cell undergone write discharge in the subfield SF2, paying similarly attention to scan block 1, the luminance is decided according to the sum of numbers of sustaining discharges in periods TP2-2, TP3-2, and TS-2. In this case, however, the number of discharges in the common sustaining period TS-2 is set to be lower than that of discharges in the common sustaining period TS-1 of the sub-field 1 so as to minimize the total to half (½) that of the sub-field SF1.

Moreover, in the sub-field SF3, the total of the numbers of sustaining discharges is set to a quarter (¼) of that of the sub-field SF1, namely, there is missing the common sustaining period.

Finally, in the sub-field SF4, the total of numbers of sustaining discharges is set to ⅛ of that of the sub-field SF1, namely, there is missing the sustaining discharge in the pre-discharge period TP3-4 of scan block 3 in addition to the common sustaining period.

Also for scan blocks 2 and 3, the sustaining discharge period is set for each sub-field.

With the provision above, assuming that luminance L is developed in response to selection in the sub-field SF4, there are attained luminance values 8 L, 4 L, 2 L, and L for the sub-fields SF1 to SF4, respectively. Consequently, in accordance with combinations of selections in the respective sub-fields, 16 luminance levels are available in each frame.

Assume, for example, that the sustaining frequency is 50 kHz and the values of illumination cycle (period of sustaining pulse) are 64, 32, 16, and 8 for the sub-fields SF1 to SF4, respectively. According to the prior method, the total of sustaining discharge periods of the field simultaneously effected for all scan blocks is $$\{1/(50\times10^3)\}\times(64+32+16+8)=2.3\times10^{-3}\text{ (seconds)}.$$

On the other hand, in accordance with the present invention, assuming that one sustaining cycle is simultaneously included in one pre-discharge period, the total of sustaining discharge periods of one field simultaneously effected for all scan blocks is $$\{1/(50\times10^3)\}\times\{(64-2\times2)+(32-2\times2)+(16-2\times2)+(8-2\times2)\}=2.08\times10^{-3}\text{ (seconds)}.$$

Consequently, when compared with the conventional method, there is attained reduction of time as follows.

$$2.3\times10^{-3}-2.08\times10^{-3}=0.22\times10^{-3}\text{ (second)}.$$

Furthermore, in a sub-field of the minimum luminance, there may be employed a combination in which the sustaining discharge period is completely missing in consideration of the luminance of illumination by the write discharge in a sub-field of the minimum luminance.

In the above case where the number of discharges is decreased depending on sub-fields, when the sustaining pulses are decreases with a lapse of time in the sustaining discharge as described above, the period of time from the write discharge to the sustaining discharge and that from the sustaining discharge which is isolated with respect to time from the subsequent sustaining discharge can be minimized down to the write period of the scan block. This advantageously facilitates transition from the write discharge to the sustaining discharge and hence stabilizes the sustaining discharge.

Figure 28:
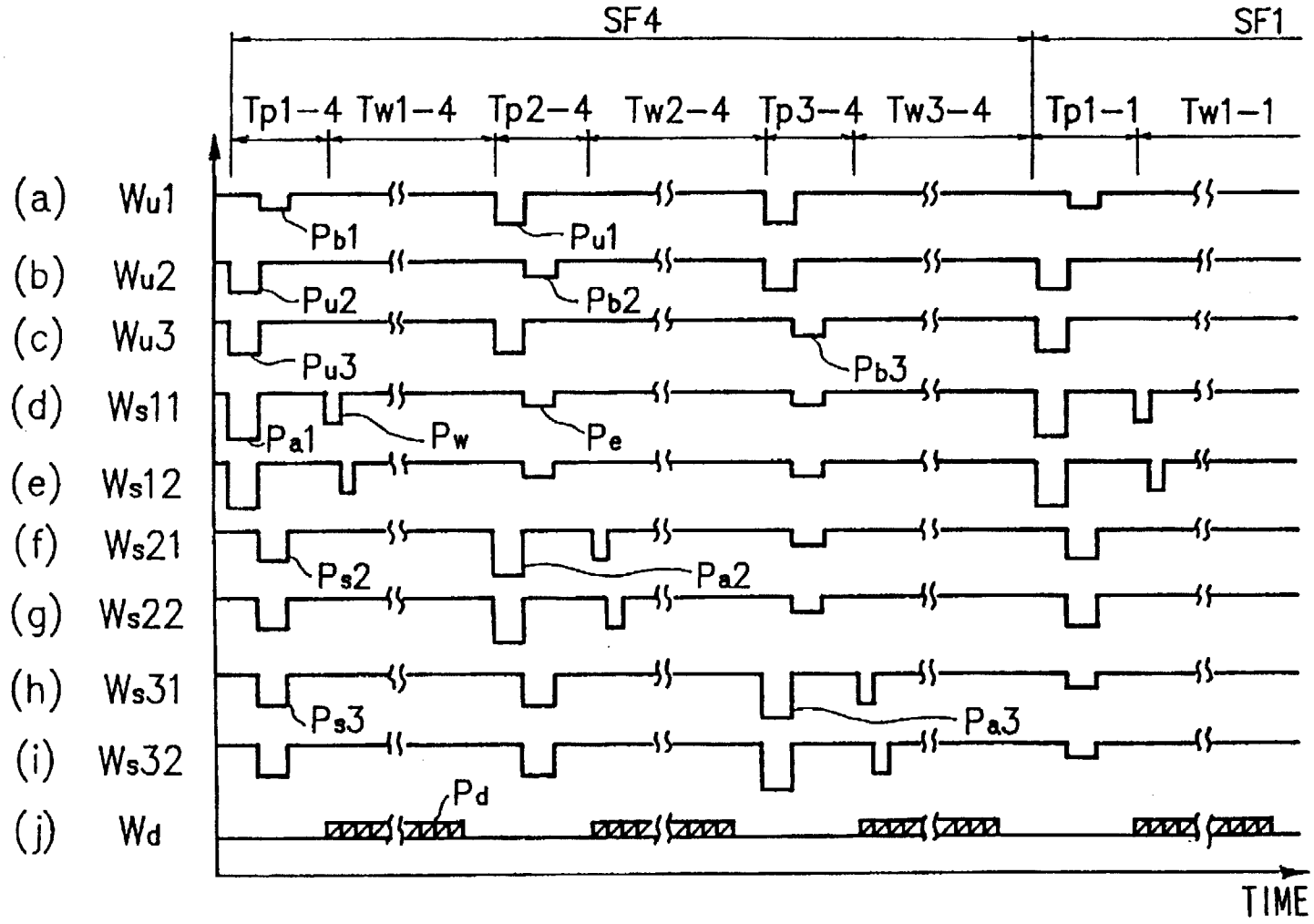
FIG. 28 is a signal timing chart schematically showing an example of driving voltage waveforms of the 14-th embodiment in accordance with the present invention.

FIG. 28 shows an example of driving voltage waveforms primarily related to the sub-field SF4 of the 14th embodiment. In this example, the basic driving sequence is almost the same as those of FIGS. 24 and 26. Description will be now given of the driving operation in the pre-discharge period particularly paying attention to periods TP2-4 to TP3-4.

The scanning electrode (driving waveform Ws21) to which a pre-discharge pulse Pa2 of scan block 2 is applied is adjacent to the sustaining electrode Su1m of scan block 1. At the timing of the pre-discharge pulse Pa2, a sustaining pulse Pu1 is being applied to the sustaining electrode Su1m (driving waveform Wu1). As can be seen from FIG. 28, the sustaining pulse Pu1 is in phase with the pre-discharge pulse Pa2.

Subsequently, at the timing of the pre-discharge erasing pulse Pb2, a sustaining discharge erasing pulse Pe is applied to the scanning electrodes Sc11 to Sc1m in the in-phase state. For the subsequent sustaining pulses, the voltage is reduced to the wall voltage to prevent the sustaining discharge.

Consequently, in the display cells of scan block 1, discharge is not caused by the sustaining pulse applied during the pre-discharge period Tp3-4 of scan block 3. The sustaining pulse however functions as a pulse to cancel the pre-discharge pulse voltage of the scanning electrode Sc31 adjacent thereto.

In the two embodiments described above, there are provided three scan blocks and four sub-fields. However, the present invention is not restricted by these numbers of blocks and sub-fields.

Figure 29:
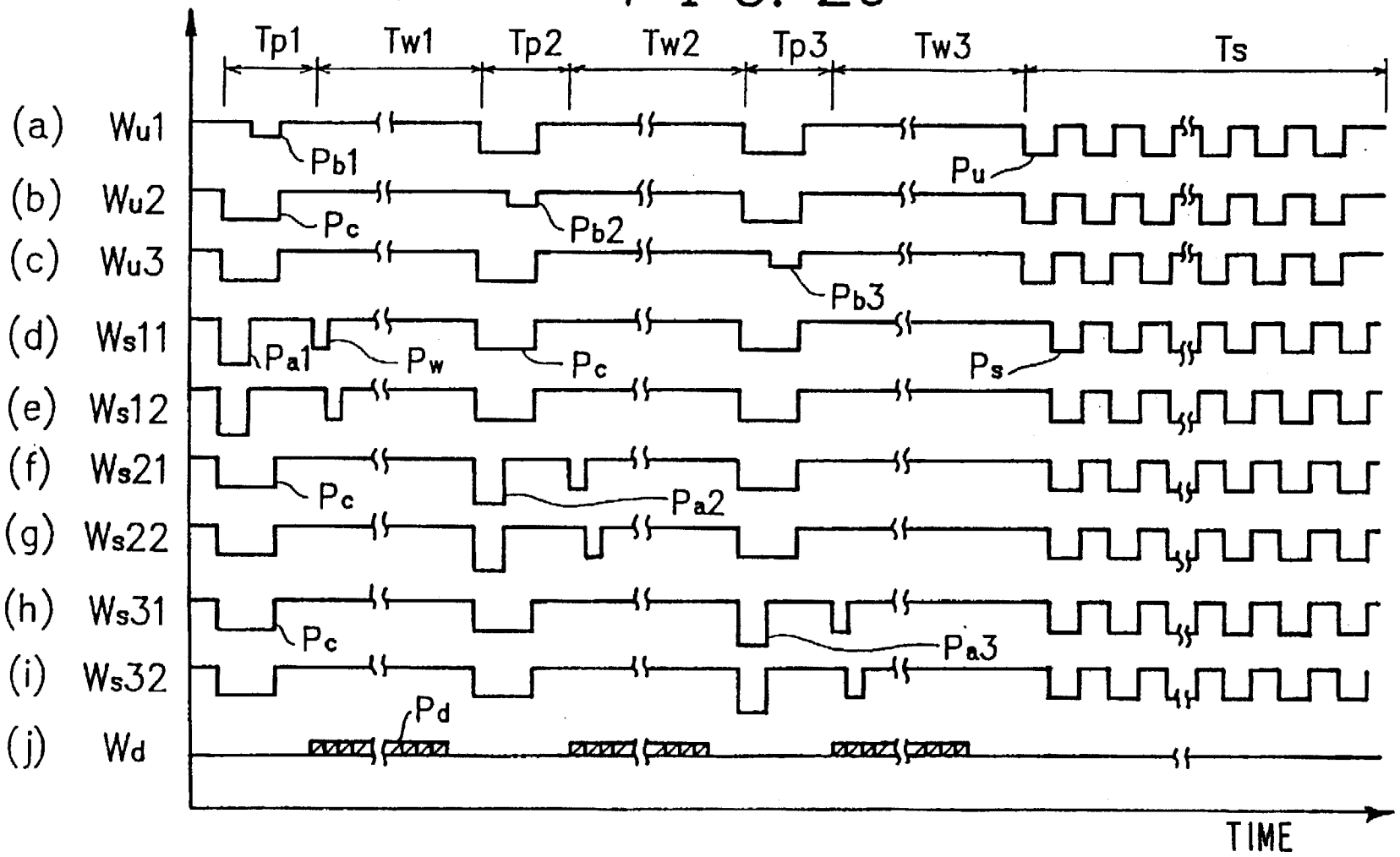
FIG. 29 is a signal timing chart showing an example of driving voltage waveforms of a 15-th embodiment in accordance with the present invention.

FIG. 29 shows an example of driving voltage waveforms of a 15th embodiment in accordance with the present invention. The operational procedures of pre-discharge, pre-discharge erasing, and scanning operation of each scan block are almost the same as the first example of the 13th embodiment. In the example of this diagram, however, during the pre-discharge period of the each scan block, an in-phase cancel pulse is applied to the scanning and sustaining electrodes of scan blocks other than the block in the pre-discharge period.

Subsequently, the driving operation in the pre-discharge period will be described primarily in consideration of the pre-discharge period Tp2.

In the entire application periods respectively of the pre-discharge pulse Pa2 of the scanning electrodes Sc21, Sc22, etc. (driving waveforms Ws21, Ws22, etc.) of scan block 2 and the pre-discharge pulse Pb2 of the sustaining electrodes Su21, Su22, etc. (driving waveform Wu2) of scan block 2, a cancel pulse Pc is applied to all scanning electrodes Sc11, Sc12, . . . , Sc31, Sc32, etc. as well as all sustaining electrodes Su11, Su12, . . . , Su31, Su32, etc. of scan blocks 1 and 3.

The cancel pulse Pc cancels the potential discrepancy appearing when the pre-discharge pulse and the pre-discharge erasing pulse are applied and hence prevents any erroneous discharge in the scan block boundary. Moreover, the cancel pulse applied to the scan block does not cause any potential difference between the scanning and sustaining electrodes thereof and consequently suppresses the erroneous discharge in the scan block.

Figure 30:
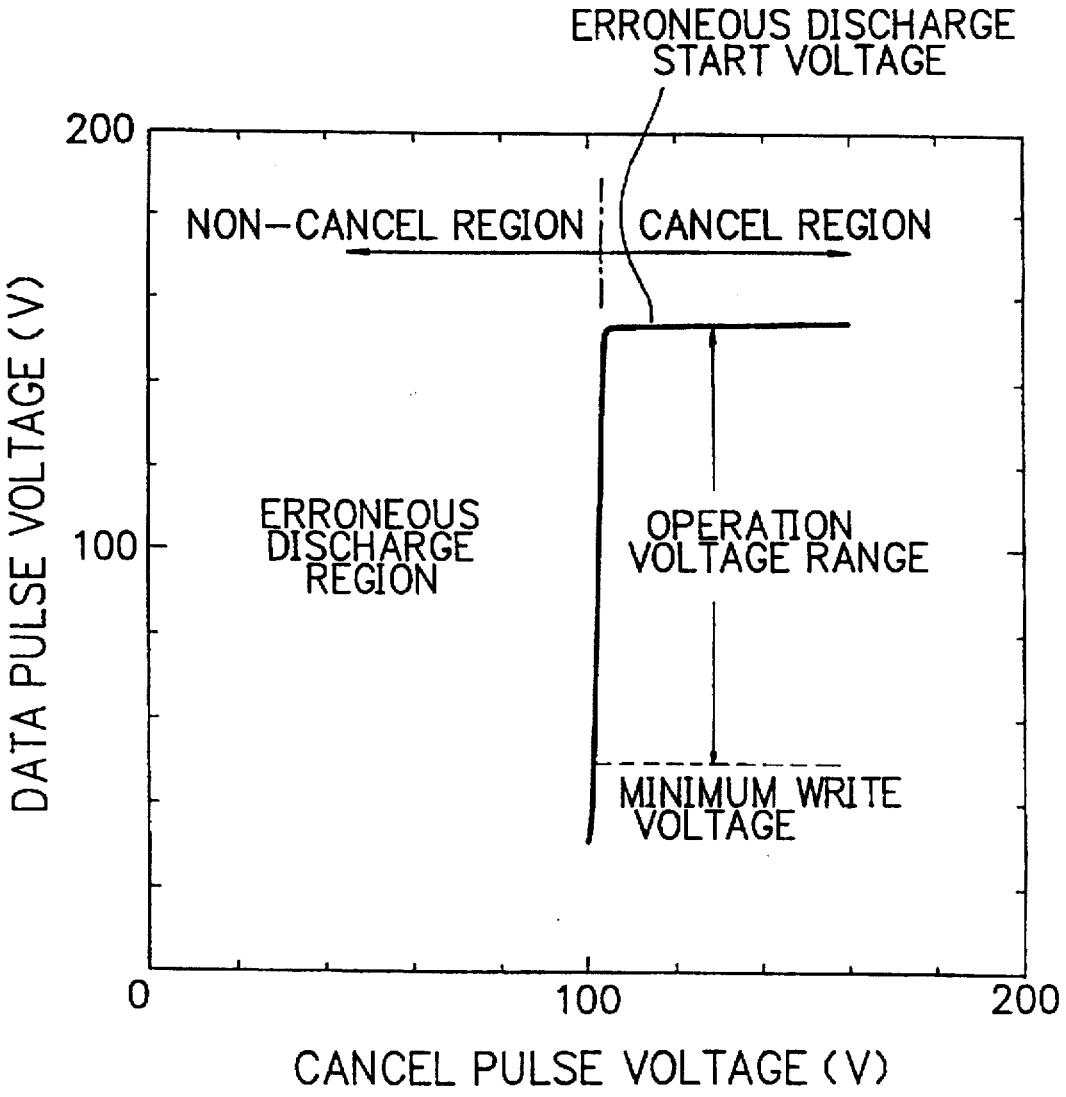
FIG. 30 is a diagram showing a voltage characteristic of the 15-th embodiment.

FIG. 30 is a graph of a relationship of the data pulse voltage to the cancel pulse voltage and shows an example of changes in the voltage causing the erroneous discharge in a cell on an electrode to which a scanning pulse is being applied.

When the cancel voltage is about 100 volts or more, the data pulse voltage at which the erroneous discharge (erroneous write) is initiated is abruptly increased to a saturated state. The pre-discharge pulse voltage is 280 volts in this situation. Consequently, in a plasma display panel used in the experiment, the block boundary voltage is set to 180 V (=280−100) V or less, thereby advantageously attaining a satisfactory write characteristic.

Furthermore, in a case where the cancel pulse voltage is sufficiently lower than the discharge starting voltage between the scanning electrode and the sustaining electrode inherently associated with the sustaining discharge, the erroneous discharge can be efficiently avoided by applying the cancel pulse to electrodes adjacent to the boundary of the scan block for the pre-discharge, namely, either one of the scanning electrodes or the sustaining electrodes.

As above, in accordance with the present invention, the scanning lines of the plasma display panel are classified into a plurality of scan blocks such that immediately before the write discharge period of each scan block, pre-discharge erasing or pre-discharge and pre-discharge erasing is or are conducted. This minimizes, between the scanning lines, the difference in the state of active particles generated by the pre-discharge and pre-discharge erasing and the discrepancy in the state of wall charge, thereby effectively reducing the characteristic difference in the write discharge.

Furthermore, in accordance with the present invention, active particles generated by the pre-discharge and pre-discharge erasing are intentionally and positively utilized to increase the data write speed. As a result, a large-capacity full-color PDP having about 1000 scanning lines can be efficiently driven to display a satisfactory image. As an application example of the PDP, there can be implemented a video display such as a wall-type full-color television set having a high resolution.

Furthermore, in the PDP driving method in accordance with the present invention, the scanning lines of PDP are classified into a plurality of scan blocks to provide for each scan block a short sustaining discharge period immediately after a write discharge period. Consequently, a small amount of wall discharge created by a weak write discharge is converted into a large number of wall charge states after sustaining discharge, thereby facilitating transition to the sustaining discharge period for all display cells at the same time.

In addition thereto, pre-discharge erasing or pre-discharge and pre-discharge erasing is or are carried out immediately before the write discharge period of each scan block, which leads to advantages of improvement of efficiency of the pre-discharge and prevention of increase in the write voltage and the write pulse width.

In accordance with active particles generated by the pre-discharge and pre-discharge erasing are positively utilized to increase the data write speed. Moreover, the pre-discharge period is efficiently used as a sustaining discharge period to achieve a PDP driving method having a high utilization ratio with respect to time.

Also, the pre-discharge pulse and the pre-discharge erasing pulse are set to be in phase with a sustaining pulse to be simultaneously applied together therewith, which prevents an erroneous discharge in the scan block boundary.

Additionally, a cancel pulse which is in phase with the pre-discharge pulse and the pre-discharge erasing pulse is applied to scan blocks not under the pre-discharge operation. As a result, the erroneous discharge is highly prevented in the scan block boundary and in the pertinent scan block.

Description has been given of the present invention by reference to a plasma display panel of a planar discharge type having a three-electrode structure. However, it is to be appreciated that the present invention is applicable to any other plasma display panels of an opposing discharge type having a two-electrode structure.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A method for driving a plasma display panel (PDP) with a PDP of an ac discharge memory type, said PDP comprising:

M scanning electrodes (M being an integer) corresponding to scanning lines of display cells formed on an identical plane;

M sustaining electrodes for sustaining discharge of the display cells;

a plurality of data electrodes disposed to be orthogonal to the scanning electrodes and the sustaining electrodes for receiving predetermined display data and being driven in response thereto to display the data; and noble gas filled in a space between the scanning and sustaining electrodes and the data electrodes, the method comprising the steps of:

subdividing said M scanning electrodes and said M sustaining electrodes respectively equally into N scanning electrode groups and N sustaining electrode groups (N being a positive integer $N \geqq 2$);

assigning a pre-discharge period of an identical time zone, a pre-discharge erasing period of the identical time zone, and a write discharge period of the identical time zone to said N scanning electrode groups and said N sustaining electrode groups, respectively; and setting a fixed period of time after termination of a write discharge period corresponding to an N-th (final) scanning electrode group and an N-th (final) sustaining electrode group as a sustaining discharge period common to all of the N scanning electrode groups and all of the N sustaining electrode groups for reducing a period of time from said pre-discharge erasing period to said write discharge period.

* * * * *